US005088717A

United States Patent [19]

Hamanaka et al.

[11] Patent Number: 5,088,717

[45] Date of Patent: Feb. 18, 1992

[54] PAPER FEEDING APPARATUS HAVING A THREE CYLINDER VACUUM MEMBER

[75] Inventors: Izumi Hamanaka; Kazuhiro Hirota, both of Hachioji, Japan

[73] Assignee: Konica Corporation, Tokyo, Japan

[21] Appl. No.: 559,637

[22] Filed: Jul. 30, 1990

[30] Foreign Application Priority Data

| | | | |
|---|---|---|---|
| Aug. 12, 1989 | [JP] | Japan | 1-208189 |
| Aug. 21, 1989 | [JP] | Japan | 1-215318 |
| Aug. 25, 1989 | [JP] | Japan | 1-220018 |
| Aug. 29, 1989 | [JP] | Japan | 1-223476 |

[51] Int. Cl.[5] ..... B65H 3/10

[52] U.S. Cl. ..... 271/98; 271/99; 271/108; 271/12

[58] Field of Search ..... 271/3.1, 5, 11, 12, 271/91, 98, 99, 108, 112

[56] References Cited

U.S. PATENT DOCUMENTS

| | | | |
|---|---|---|---|
| 3,851,871 | 12/1974 | Aronson | 271/99 |
| 4,127,263 | 11/1978 | Wenthe | 271/99 |
| 4,168,829 | 9/1979 | Wilson et al. | 271/99 |
| 4,269,405 | 5/1981 | Mitzel | 271/99 |
| 4,324,394 | 4/1982 | Mitzel et al. | 271/98 |
| 4,362,380 | 12/1982 | Dragstedt | 271/108 |
| 4,421,306 | 12/1983 | Muka | 271/108 |
| 4,526,359 | 7/1985 | Garavuso | 271/98 |
| 4,548,395 | 10/1985 | Snellman et al. | 271/99 |
| 4,583,729 | 4/1986 | Blumle | 271/108 |
| 4,585,222 | 4/1986 | Nishibori et al. | 271/108 |
| 4,739,982 | 4/1988 | Hain | 271/99 |

FOREIGN PATENT DOCUMENTS

| | | | |
|---|---|---|---|
| 48826 | 4/1982 | European Pat. Off. | 271/5 |
| 361259 | 4/1990 | European Pat. Off. | 271/98 |
| 2521933 | 11/1975 | Fed. Rep. of Germany | 271/207 |
| 3531145 | 3/1987 | Fed. Rep. of Germany | 271/108 |
| 69637 | 4/1983 | Japan | 271/99 |
| 37636 | 2/1986 | Japan | 271/108 |
| 16947 | 1/1987 | Japan | 271/98 |

*Primary Examiner*—Robert P. Olszewski
*Assistant Examiner*—Steven Reiss
*Attorney, Agent, or Firm*—Jordan B. Bierman

[57] ABSTRACT

The invention provides an apparatus for feeding a paper in which there are provided a stacker for placing a stack of papers and threefold cylinder for separating the lowermost paper by vacuum suction from the stack of papers placed on the stacker and sequentially feeding the separated paper one by one. The threefold cylinder is disposed below the stacker in the vicinity of the leading edge of the stacker in relation to the feeding direction. And, the threefold cylinder includes a first cylinder rotatable and provided with a number of through holes on the circumferential surface; a second cylinder, installed inside the first cylinder, provided with a slit-shaped opening on the circumferential surface; a third cylinder, installed inside the second cylinder, provided with a slit-shaped opening on the circumferential surface thereof. The third cylinder is connected to vacuum suction.

22 Claims, 16 Drawing Sheets

PAPER FEEDING APPARATUS HAVING A THREE CYLINDER VACUUM MEMBER

BACKGROUND OF THE INVENTION

This invention relates to improvements in a paper feeding apparatus used in an electrostatic copier or a document image reader in which the lowermost document in a document stack placed on a document stacker can be separated one by one and conveyed to the exposure position on a platen glass.

A recirculating document handler (RDH) and an automatic document feeder (ADF) are used as an automatic document feeder in which a plurality of documents are stacked on a document stacker and the documents are conveyed onto a platen glass of a copier. The paper separating efficiency of a document feeding unit is very important in this kind of apparatus.

The bottom conveyance type of document feeding apparatus is conventionally used as it is excellent in the paper separating efficiency. In Japanese Patent Application O.P.I Publication Nos. 69637/1983 and 76775/1976, this type of document feeding apparatus is disclosed. This apparatus is composed in such a manner that: the lowermost document stacked on a document stacker is separated from the stack and conveyed to the processing unit one by one; and the document is returned to the document stacker or a delivery stacker after the document is exposed.

A typical document feeder of a recirculating document handler (RDH) which realizes the bottom conveyance type of document feeder mentioned above, is the bottom conveyance and upper piling type of document feeder which is composed in such a manner that: a document feed opening is provided to the lower edge-portion of a document feeding unit; a document which is sent from the first document feeding unit close to the document feeding port, is guided from the second document feeding unit through the document feeding passage onto the upper surface of the platen glass of a copier; the document is moved on the platen glass to the exposure position by the motion of a conveyance belt provided on a platen glass; when the document is placed at the exposure position, an optical exposure system is reciprocated in order to expose the document; the exposed document is moved by the motion of the conveyance belt; and the document is conveyed through the recirculating passage and stacked on the uppermost position of the document stack placed on the document stacker.

In the conventional document feeder described above, the first document feeding unit is composed of: a document feeding belt which feeds the lowermost document of the document stack placed on the document feeding position; and a stop roller which comes into contact with the document feeding belt with pressure in order to prevent double feeding of documents. However, in the case of the document feeding apparatus described above, when the documents located at the regular position on the document stacker, are pushed by a push belt to the document feeding position, a plurality of documents are squeezed into the wedge-shaped portion formed by a document feeding belt and a stop roller and furthermore the documents enter into the nip portion.

Furthermore, as the above-mentioned stop roller comes into contact with the above-mentioned document feeding belt with pressure, the front side of the document and the reverse side of another document are rubbed with each other, so that the document surfaces are stained and the image on the document is damaged.

In order to solve the problems described above, the separating document feed system has been proposed in which the suction force or the blowing force by air is used.

The first type of the system was disclosed by the U.S. Pat. No. 4,345,751, which is the rotary suction document separating type of document feeding apparatus in which an rotating vacuum cylinder and the document conveyance unit are combined. This system is characterized in that: a vacuum suction cylinder is provided close to the tip of a document stack located on a document stacker; only the lowermost document of the stack is separated from the document stack by the suction force of the vacuum suction cylinder; and the separated document is adhered to the curved surface of the cylinder and sent downward so that the document can be transfered to the following conveyance unit. After the document is conveyed by the vacuum cylinder, the opening portion of the cylinder is returned to the position right below the document stack.

The cylinder unit of the document feeding apparatus of this proposal must be provided with a mechanism which is characterized in that: when a document is delivered, the vacuum suction is turned on; and when the cylinder is returned, the vacuum suction is turned off.

Furthermore, a strong vacuum suction unit by which the heavy static pressure can be generated, is necessary in order to increase the document separation force, so that it causes such problems that: the noise is increased; a wide space is necessary to install the unit; and the manufacturing cost of the document feed unit is increased.

In this rotating vacuum cylinder type of document feeding apparatus, a pipe made from aluminum alloy is used as a suction and conveyance surface. When the coefficient ($\mu$) of friction between the aluminum alloy surface and the document surface is 0.3 to 0.5 and the coefficient of friction between the document surfaces is 1.0, the force necessary to pull out a document from a document stack composed of documents of A3 size, is about 1 kg The force needed to pull out a document from a document stack is determined by the area of the opening of the vacuum cylinder, the static suction pressure, and the coefficient ($\mu$) of surface friction. When a strong force is given to a document in order to pull it out from a stack, the front side of one document and the reverse side of the other document are rubbed, which causes such a problem that the surfaces of documents are stained and damaged, so that the quality of images is deteriorated.

The above-mentioned vacuum cylinder and the conveyance roller must be eccentrically placed to the vacuum belt (the negative pressure belt) and their insides must be divided into two in the case of a document feeding apparatus which is composed in such a structure that: a plurality of throughholes are provided to the endless belt which conveys a document from the document stack to the platen glass; and negative pressure is activated to the document through the holes on the belt.

In the case of a plurality of endless negative pressure belt, the irregularity of speed is liable to occur among the belts. As a result, the conveyed document is sometimes deformed. Unless the deformation of a document is eliminated before copying, the document image can not be formed on a recording paper correctly. Furthermore, the structure and motion of this type of document feeding apparatus are complicated and especially the rotating mechanism of the suction drum is complicated.

Further, U.S. Pat. Nos. 4,284,270, 4,324,395, 4,411,417, and the like disclose another conventional document feeding system, which is called the air-knife document separating system.

In this document feeding system, the lowermost document is conveyed by a vacuum belt in such a manner that: the lowermost document of a document stack is sucked by a vacuum suction belt having a protruded portion in the middle so that a space can be made between the document and the document stack; air is blown into the space so that the document stack can be floated by air pressure; and the lowermost document can be pulled out from the stack.

When the document has been delivered from the above-described vacuum suction belt to the following conveyance roller, the vacuum suction must be stopped until the trailing end of the document passes through the vacuum suction belt. The reason to stop the vacuum suction is that: if the vacuum suction is continued after the document is delivered to the conveyance roller, the document is rubbed by the vacuum belt or the document is pulled by the vacuum suction belt. Consequently, it is necessary for the vacuum suction belt unit to be turned on or off every time a document is fed. For that reason, consideration must be given to the suction preparing time which is defined as the time (about some hundreds millisecond) necessary to start the vacuum suction after the vacuum unit is turned on. The suction preparing time is 10 times longer than that of the conventional friction separating type of document feeder, wherein in the case of the conventional friction separating type of document feeder, this suction preparing time is 30 to 50 ms which is the same as the response time of a magnetic clutch. As a result, the response lag of the air-knife separating system is 10 times larger than that of the conventional magnetic clutch system. For that reason, the air-knife separating system is inferior from the view point of the follow-up ability at a high speed, so that it is not suitable for high speed document separation and conveyance. Accordingly, these types of document feeding apparatuses have such problems that: (1) the shape of the document stacker surface is not simple, so that the shape of the suction box can not cope with various sizes of documents; (2) as the document is sucked by an air gap, the lead time is necessary, so that these types of document feeding apparatuses are not suitable for high speed document feeding; (3) as a special blower is necessary for these types of document feeding apparatuses, the control is complicated and the cost is increased.

SUMMARY OF THE INVENTION

The object of the present invention is to solve the above-described problems by providing a document feeding apparatus which is characterized in that: a document is reliably and stably separated and conveyed at a high speed; and the damage and stain of a document and the deformation of an image, these defects tend to occur in the friction handling system, can be prevented.

Another object of the present invention is to make the structure of the document feeding apparatus which can accomplish the above-described object, compact and simplified, and furthermore to make the apparatus reliable in its operation and control.

The above-described object of the present invention can be accomplished by a document feeding apparatus in which the lowermost document of a document stack placed on a document stacker is separated one by one and conveyed in order, and which is characterized in that: the first cylinder is provided to the lower position close to the front edge of the above-described document stacker in the direction of document conveyance, wherein the first cylinder is composed in such a manner that a plurality of small holes are provided to the circumferential surface of a pipe-shaped cylindrical body which can be rotated; the second cylinder is installed inside the first cylinder, wherein the second cylinder is composed in such a manner that a slit-shaped opening is provided on the circumferential surface of a pipe-shaped cylindrical body; the third cylinder is installed inside the second cylinder, wherein the third cylinder is composed in such a manner that a slit-shaped opening is provided on the circumferential surface of a pipe-shaped cylindrical body; and accordingly the document feeding apparatus is composed of a threefold pipe mechanism of the first, second and third cylinders which sucks and separates a document. In the above-described threefold pipe mechanism, the above-described first, second and third cylinders are located on the same shaft and the circumferential surfaces of the cylinders are concentric.

The circumferential surface of either of the second cylinder and the third cylinder is provided with a slit-shaped vacuum suction opening in the axial direction of the cylinder. The circumferential surface of the other cylinder is provided with a plurality of slit-shaped openings with different length in the axial direction of the cylinder corresponding to a plurality of sizes of documents to be fed.

In the above-described composition of a document feeding apparatus, the above-described second cylinder or the third cylinder which has a plurality of slit-shaped openings, is rotated and held at a predetermined angular position according to the signal of a plurality of document sizes.

After that, the other cylinder is rotated so that the composed opening formed by the slit-shaped openings of both cylinders is gradually opened and the lowermost document of a document stack is sucked and separated. After the above-mentioned composed opening is expanded, the above-mentioned first cylinder is rotated so that the above-mentioned document can be conveyed.

In the document feeding apparatus of the present invention, after the slit-shaped openings of the above-mentioned second cylinder and the third cylinder have been matched and the composed opening has been fully opened, the above-mentioned first cylinder is rotated in order to convey the above-mentioned document.

A preferable embodiment of the above-described composition of a document feeding apparatus can be described as follows: either of the second cylinder and the third cylinder is kept stopped and the other cylinder is rotated so that the composed opening formed by the slit-shaped openings of both cylinders is gradually shifted from the closed state to the open state and the lowermost of the document stack is sucked and separated; and after both openings have been matched and the composed opening has been kept fully open for a predetermined time, the first cylinder is rotated in order to convey the above-mentioned document.

It is preferable that in the above-described threefold pipe suction mechanism, a layer with a large coefficient of friction is provided around the circumferential surface of the above-described cylindrical body of the first cylinder. The above-described layer can be formed by a rubber sheet.

A preferable embodiment of the present invention is a document feeding apparatus in which the lowermost document of a document stack is separated one by one and conveyed in order, and which is characterized in that: an outside cylinder is rotatably installed at the lower position close to the front edge of the document stacker in the direction of document conveyance, wherein the outside cylinder is composed in such a manner that a plurality of small holes are provided around a pipe-shaped cylindrical body; at least one inside cylinder is installed inside the outside cylinder, wherein the inside cylinder is composed in such a manner that a slit-shaped opening is provided around the circumferential surface of a pipe-shaped cylindrical body; a suction unit which is connected with the inside cylinder, is provided to the document feeding apparatus; a vacuum conveyance means to suck and convey the lowermost document of a stack, is provided; and a blast means is provided by which compressed air is blown out to the outside cylinder surface and to the vicinity of the front edge of the document stack so that the lowermost document of the document stack can be separated.

PREFERRED EMBODIMENT OF THE INVENTION

Referring now to the attached drawings, the examples of the present invention will be described in detail.

In the following example, the present invention is applied to a recirculating document handler (RDH) in which a document is circulated in the equipment. It should be understood that the document feeding equipment of the present invention is not limited to the specific example but it can be applied to an automatic document feeder (ADF), a document reader, and the like.

Figure 1:
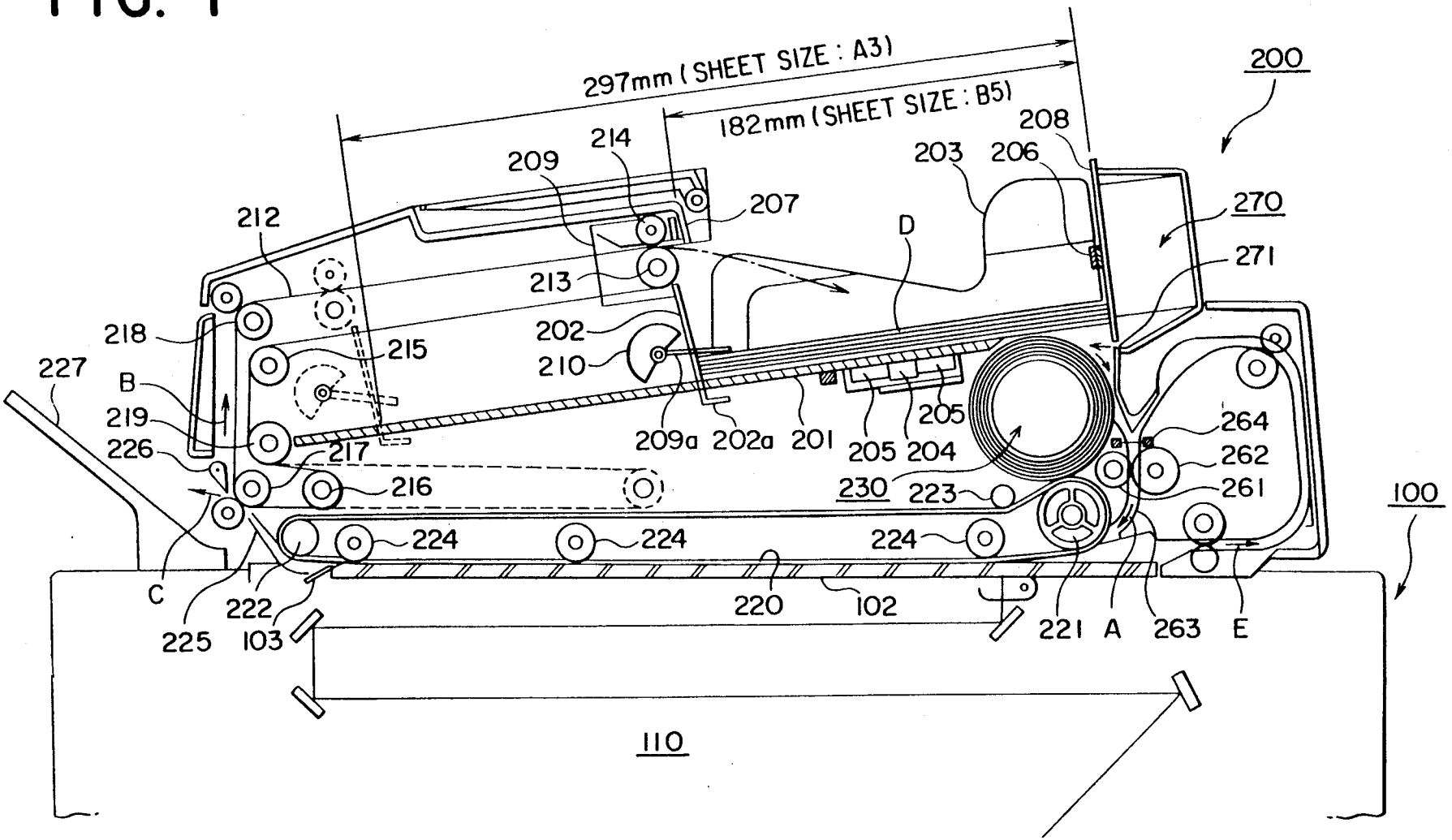
FIG. 1 is a sectional front view of an example of the document conveyance apparatus of the present invention.

FIG. 1 is a sectional front view of the recirculating type document feeder 200 which is installed on the copier body 100. In FIG. 1, the numeral 100 is a copier body and the numeral 200 is a recirculating type document feeder to which the document feeding mechanism of the present invention is applied. The recirculating type document feeder 200 is provided with the document stacker 201, wherein the down stream portion of document flow of the document stacker 201 is set upward as illustrated in FIG. 1. The document stacker 201 is provided with the trailing end regulating plate 202 against which the trailing ends of documents D are bumped when documents D are set on the stacker, and provided with the side regulating plate 203 by which the side edges of documents D are arranged. On the lower surface of the document stacker 201, the side regulating plates 203 are connected with a pair of racks 205, 205 which engage with a pinion 204 and can be slid in the opposite direction with each other, so that the side regulating plates 203 can be moved symmetrically with regard to the center line of the document. The width of documents D can be identified by detecting the movable position of the side regulating plate 203 with a sensor which is not illustrated in the drawing. The above-described trailing end regulating plate 202 has the function of pushing documents D placed on the document stacker 201 so that the leading edge of documents D can reach the document stopper 208 and the detecting position (the fixed position) of the stack sensor 206.

The numeral 208 is a document stopper which is located close to the document feed inlet in the document feeding direction and the document stopper is fixed to the frame of the document feed unit.

The blast means 270 is provided to the back of the document stopper 208 and air is blown out from the outlet 271 located downward in order to assist the separation of documents.

The numeral 207 is a sensor which can detect documents D placed on the document stacker 201. The sensor 207 is installed on the upper moving unit 209 located at the front upper position of the above-described trailing end regulating plate 202 so that the sensor 207 can be moved integrally with the trailing end restricting plate 202.

The sensor 207 can always optically detect whether documents D are set on the document stacker 201 or not in any cases such as: when document D are stopped at the initial position on the document stacker 201; when the trailing ends of documents D are pushed and slid on the document stacker 201; and when the leading edge of documents D reach the feeding start position. Accordingly, a useless copy operation can be prevented, wherein the useless copy operation can be described as follows: documents D are not set on the document stacker 201, nevertheless a copy motion starts.

The above-described sensor 207 to detect document setting, is provided on the document delivery guide plate of the upper moving unit 209, wherein the front portion of the sensor 207 is protruded forward. A through hole is provided to the front lower face of the frame on which the sensor 207 is installed. The light projected on the sensor 207 from the inside of the frame and the reflected light to the sensor, pass through the above-described through hole in the frame. The above-described sensor 207 is composed in such a manner that: the light emitting unit composed of a LED and the light receiving unit composed of a phototransistor are provided to the same frame. The light projected from the light emitting unit (LED) passes through the through hole in the frame and reaches the reflecting plate 202*a* which is integrally protruded forward from the lower edge-portion of the trailing end regulating plate 202. The light reflected by the reflection plate 202*a* passes the through hole in the frame again and reaches the light receiving unit (the phototransistor).

The above-described upper moving unit 209 is provided with the trailing end regulating plate 202 and the sensor 207 to detect documents. Furthermore, the document separator 210 is provided to the middle of the upper moving unit 209.

In the case of the recirculating document feeder described above, it is necessary to detect the circulation of documents. In order to attain the object of detecting the document circulation, the above-described separator 210 is operated as follows: the separating arm 209A of the separator 210 is set beforehand on the uppermost document of the document stack placed on the document stacker 201; the circulated documents are stacked on the separating arm in order; when the last document which comes into contact with the separating arm 209A is fed, the separating arm 209A is withdrawn from the document stacking position; and when the last document is returned onto the document stacker and stacked on the uppermost document of the stack, the above-described separating arm 209A comes into contact with the uppermost document of the stack.

The upper moving unit 209 is provided with the edge-portion roller 213 which is rotated by the delivery belt 212 and provided with the idle roller 214 which is rotated coming into contact with the edge-portion roller 213 with pressure. The delivery belt 212 is stretched by: the drive roller 215 which is connected with the main motor through a one-way-clutch; the upper edge-portion roller 213 which can be horizontally moved along the upper and lower sides of the document stacker 201; the lower edge roller 216; and a group of auxiliary rollers 217, 218, and 219. The delivery belt 212 is stretched forming a C-shape surrounding the rear portion of the document stacker 201. When the above-described drive roller 215 is driven in a constant direction, the delivery belt 212 conveys document D delivered from the conveyance belt in the delivery direction.

The numeral 220 is a conveyance belt which conveys document D in the normal and reverse direction on the platen glass 102. This conveyance belt 220 is stretched between the first roller 221 which is located on the entry side and is connected with the main motor through a revolution changeover means, and the second roller 222 which is located on the delivery side. The tension roller 223 comes into contact with the upper surface of the belt close to the first roller 221 side. A plurality of squeeze roller 224, 224, 224 come into contact with the belt surface with pressure so that the lower belt surface can slidably come into contact with the platen glass 102.

The above-described first roller 221 and the second roller 222 are connected with each other by a timing belt not illustrated in the drawings. When the conveyance belt 220 is rotated in the normal direction (clockwise in FIG. 1), it is driven by the drive force of the first roller 221 and the lower side belt becomes a slack side. In this case, the second roller 222 slips by the action of the one-way-clutch. When the above-described conveyance belt 220 is rotated in the opposite direction (counterclockwise), the one-way-clutch is locked and the conveyance belt 220 is driven by the second roller 222. In other words, there are two cases in driving the conveyance belt, one is the case in which the conveyance belt 220 is driven by the first roller 221 and the other is the case in which the conveyance belt 220 is driven by the second roller 222, which is especially useful when synchronous exposure is conducted while document D is moved on the platen glass 102.

The numeral 103 is a document stopper which is provided to the delivery side edge-portion of the platen glass 102 and this stopper can be raised and lowered with regard to the platen glass 102. This document stopper 103 is operated in such a manner that: while the document is conveyed at a synchronous exposure speed on the platen glass 102 by the conveyance belt 220 as in the case of the document circulating copy mode, the optical exposure system 110 in which the stationary mode or the moving mode can be selected and which is located just below the platen glass, conducts exposure as fixed so that an image can be formed on a photoreceptor drum, and in this case the document stopper 103 is lowered under the platen glass; and while the document is stopped at the exposure position on the platen glass 102 as in the case of ADF or SDF mode, the above-described optical system 110 is moved so that exposure can be conducted in order to form an image on the photoreceptor drum, and in this case the document stopper 103 is protruded from the platen glass 102.

The numeral 225 is a delivery guide plate which is provided to the delivery side of the above-described platen glass. The numeral 226 is a changeover claw installed on the middle way of the above-described delivery guide plate 225, and this claw changes over the passages of a document between the circulating delivery passage B which is directed to the document stacker 201 and the outside delivery passage B which is directed to the delivery tray 227 located outside the apparatus. When the above-described trailing end regulating plate 202 is returned to the home position, the claw 226 opens the outside delivery passage C, and when the trailing end regulating plate is not at the home position, the claw 226 opens the circulating delivery passage B.

Passage E is a document reverse passage which is used when a two-sided copy is conducted. Document D is reversed by this passage E and conveyed again onto the platen glass 102.

Figure 2:
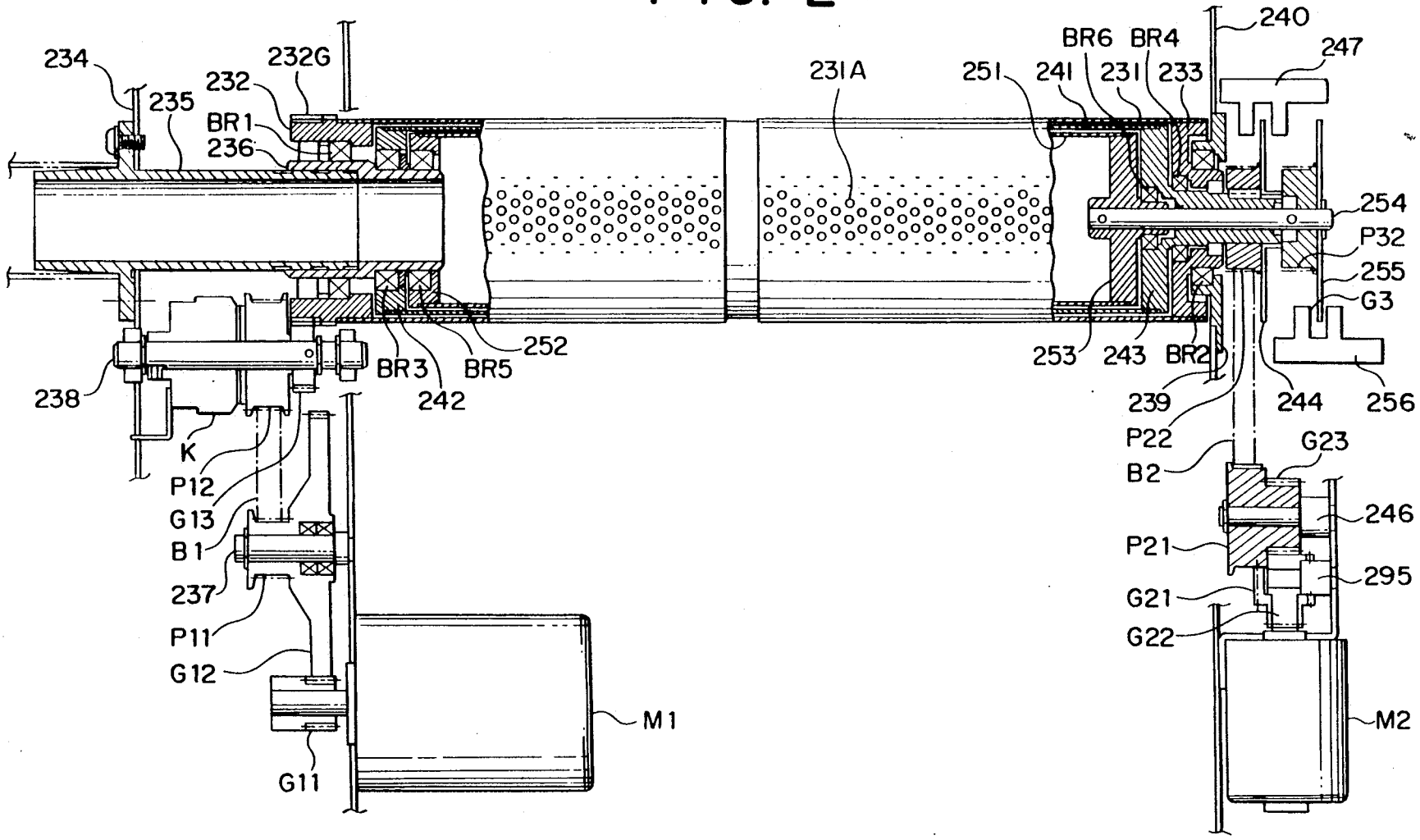
FIG. 2 is a partial sectional front view of the threefold pipe mechanism of the apparatus illustrated in FIG. 1.
Figure 3:
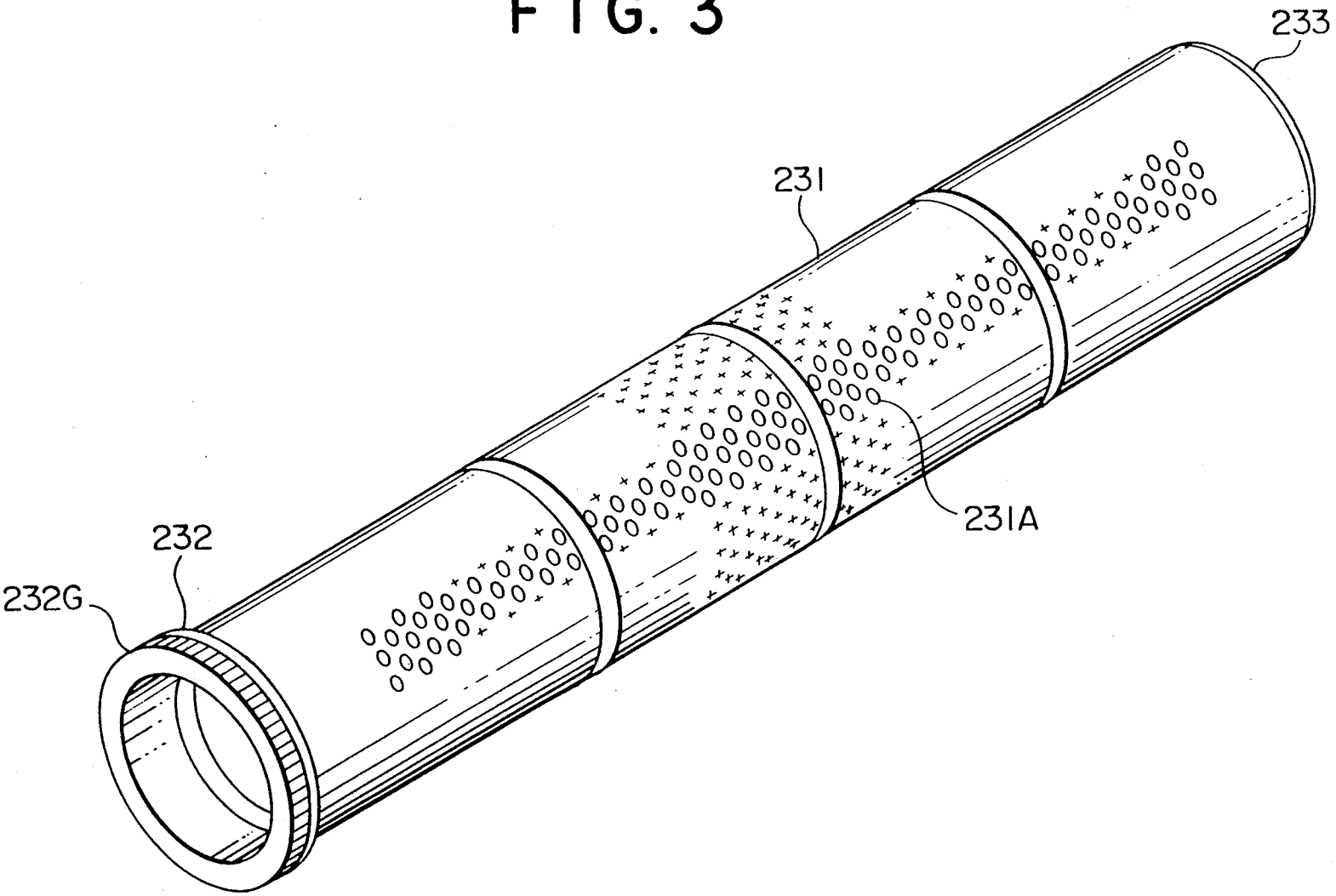
FIG. 3 is a perspective view of the first cylinder.
Figure 4:
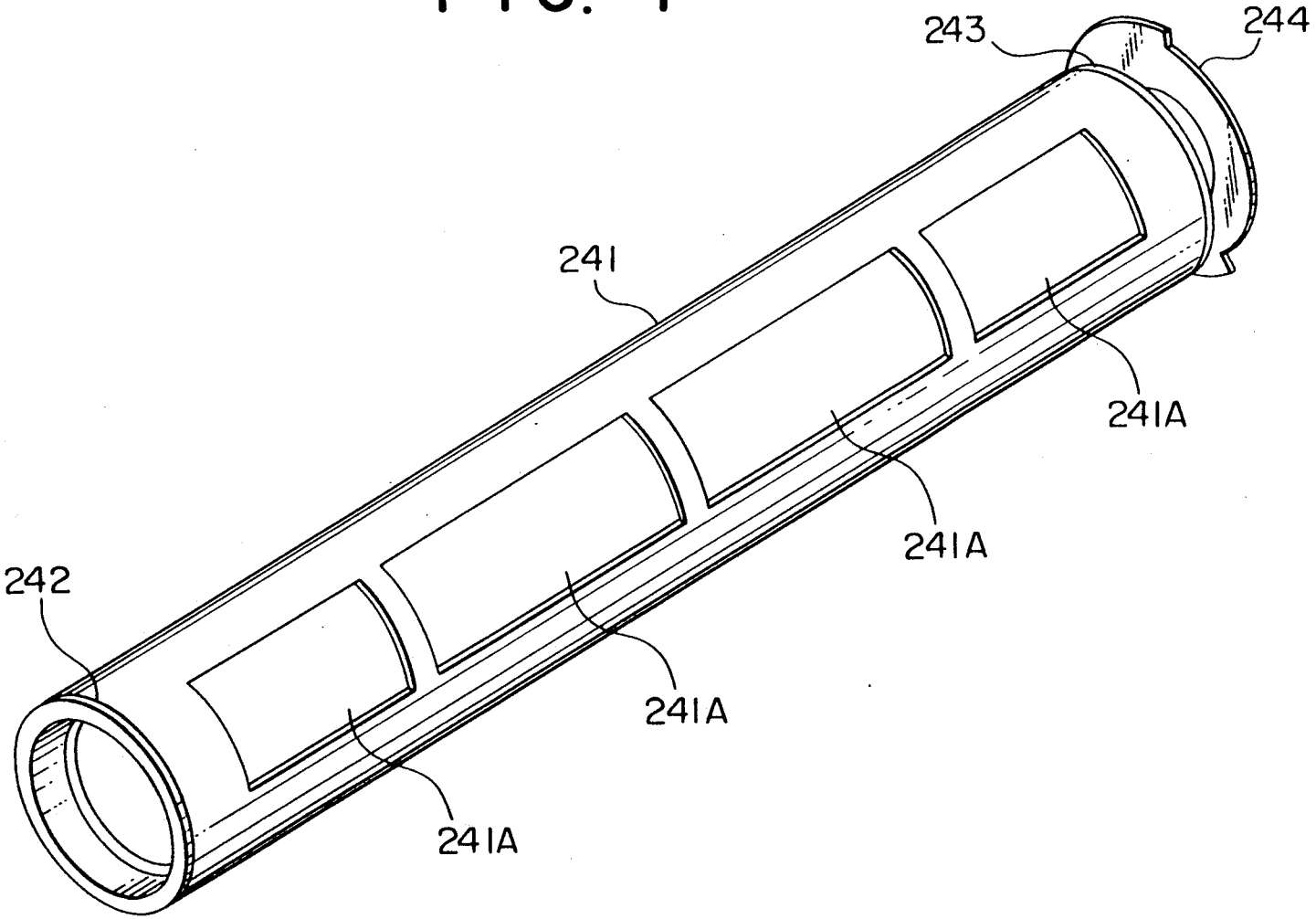
FIG. 4 is a perspective view of the second cylinder.
Figure 5:
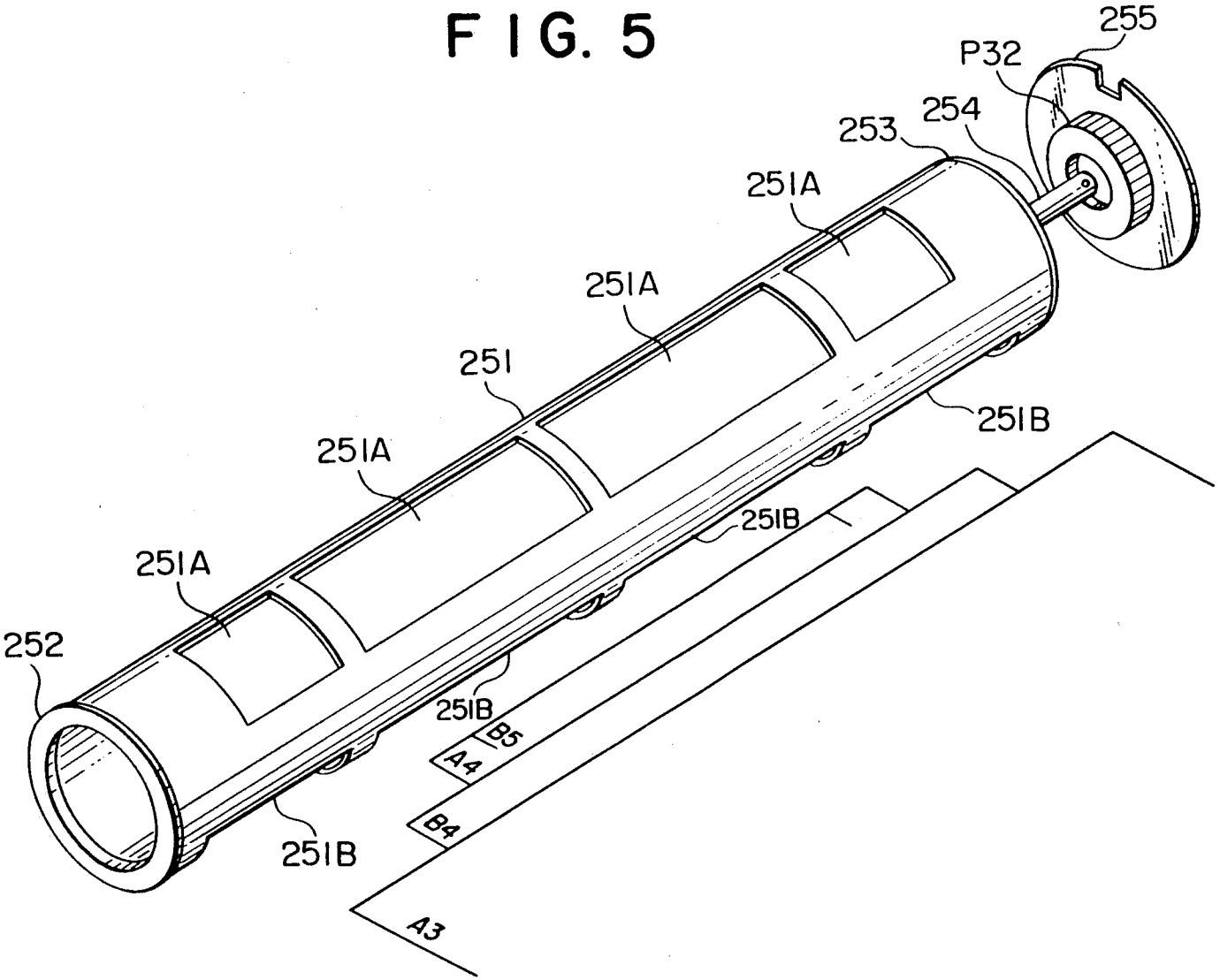
FIG. 5 is a perspective view of the third cylinder.

The numeral 230 is a suction cylinder unit which separates documents one by one from a document stack placed on a predetermined position and feeds the separated document onto the platen glass 102., FIG. 2 is a partial sectional plan view of the above-described suction cylinder unit. FIG. 3 is a perspective view of the most outside pipe member of the cylinder unit. FIG. 4 is a perspective view of the middle pipe member. FIG. 5 is a perspective view of the most inside pipe member.

The above-described cylinder unit 230 is composed of the most outside pipe member 231 (the first cylinder), the middle pipe member 241 (the second cylinder), the most inside pipe member 251 (the third cylinder), and a drive means to rotate these pipe member.

The most outside pipe member 231 (the first cylinder) is formed by a thin circular pipe made from aluminum alloy and a plurality of small through-holes 231A are provided on its circumferential surface which is covered by a synthetic rubber. The size of the above-described through-holes 231A is 3 to 10 mm and they are laid out at right angles or zigzag. The synthetic rubber which coats the first cylinder is selected from the materials which have a high coefficient of friction and are excellent in strength, heat-resistance, low temperature resistance, abrasion resistance, oil resistance, and adhesion characteristic, for example the following can be used and applied to the circumferential surface of the pipe member by the method of coating or spraying so that a film of uniform thickness is formed. They are ethylene propylene rubber (EPDM), chloroprene rubber, urethane rubber, styrene rubber, acrylic rubber, butyl rubber, butadiene rubber, silicone rubber, fluorine contained rubber, and the like.

For example, when the metal surface, the friction coefficient of which to the paper document is described as $\mu=0.3$, is changed into a synthetic rubber surface by coating, the friction coefficient of which is described as $\mu=1.2$, the slippage between the surface and the document can be eliminated and the document can be strongly held in close contact with the curved surface of the most outside pipe member 231. As a result, it has become possible to reduce the static suction pressure to $\frac{1}{4}$.

The flanges 232, 233 are integrally engaged with the openings of both sides of the most outside pipe member 231.

The bearing BR1 is provided to the inside of the above-described flange 232. The bearing BR1 is provided to the outside of the suction connecting pipe 236 which is connected with the suction pipe 235 provided to the side plate 234, so that the suction connecting pipe 236 is rotatably supported by the bearing BR1 to the suction pipe 235.

The gear 232G is integrally formed on a portion of the outside of the above-described flange 232. The drive force of motor M1 is transmitted to the gear 232G fixed to one end of the above-described most outside pipe member 231 in such a manner that: the pinion, G11 is driven by motor Ml; the gear G12 and the toothed pulley P11 provided to the first intermediate shaft 237 are rotated by the pinion G11; the toothed pulley P12 and the gear G13 which are connected with clutch K provided to the second intermediate shaft 238, are rotated by the toothed pulley P11 through the toothed belt B1 and the gear 232G fixed to one end of the above-described most outside pipe member 231, is driven by the gear G13.

At the same time, the above-described toothed belt B1 rotates the intermediate conveyance rollers 261, 262 through the third intermediate shaft not illustrated in the drawings, wherein the third intermediate shaft has the same shape as the second intermediate shaft. The numeral 263 is a guide plate and the numeral 264 is a sensor to detect the leading edge of a document.

The bearing BR2 is provided to the outside of the boss of the flange of the other end of the most outside pipe member 231. The bearing BR2 is supported by the supporting member 239 which is fixed to the side plate 240. Consequently, both sides of the most outside pipe member 231 are rotatably supported by the side plates 234, 240. The most outside pipe member 231 sucks a document through the above described small through-holes 231A, so that the sucked document comes into close contact with the cylindrical surface of the pipe member 231 in order to be conveyed, wherein the rotation of the pipe member 231 is controlled to rotate or to stop.

The middle pipe member (the second cylinder) 241 is made of a thin circular pipe made from aluminum alloy. The rectangular openings 241A, 241A, 241A, 241A are formed on a portion of the circumferential surface of the second cylinder. The opening angle $\alpha$ of these openings 241A is set to be 10° to 80°.

The flanges 242, 243 are integrally engaged with the inside of the openings of both sides of the above-described middle pipe member 241.

The bearing BR3 is provided to the inside of the above-described flange 242 and the bearing BR3 is engaged with the circumferential surface of the above-described suction connecting pipe 236 so as to be rotatably supported.

On the other hand, the bearing BR4 is engaged with the outside of the boss of the flange 243, so that the flange 243 is engaged with the above-described flange 233 through the bearing BR4. As a result, the flange 243 is rotatably supported by the flange 233. The toothed pulley P22 and the cam 244 are fixed to the tip of the boss of the above-described flange 243. Motor M2 drives the toothed pulley P22 in such a manner that: the pinion gear G21 is driven by motor M2; the gear G23 and the toothed pulley P21 provided to the second intermediate shaft 246 are rotated by the pinion gear G21 through the gear G22 which is idly provided to the first intermediate shaft 245; and the toothed pulley P22 is driven by the toothed pulley P21 through the toothed belt B2.

The above-described cam 244 opens and closes the optical passage of the transmission type of optically coupled element 247 so that the rotation of the middle pipe member 241 can be controlled.

The middle pipe member 241 has the function of a shutter to suck and separate a document by the negative pressure from the openings 241A, and the middle pipe member 241 is rotated by one revolution to convey a sheet of document and after that it is stopped.

The most inside pipe member 251 (the third cylinder) is formed of a thin circular pipe made from aluminum, for instance, and the rectangular openings 251A, 251A, 251A, 251A are provided to a portion of its circumferential surface. The opening angle $\beta$ of the openings 251A is set to be 10° to 80°.

Figure 6:
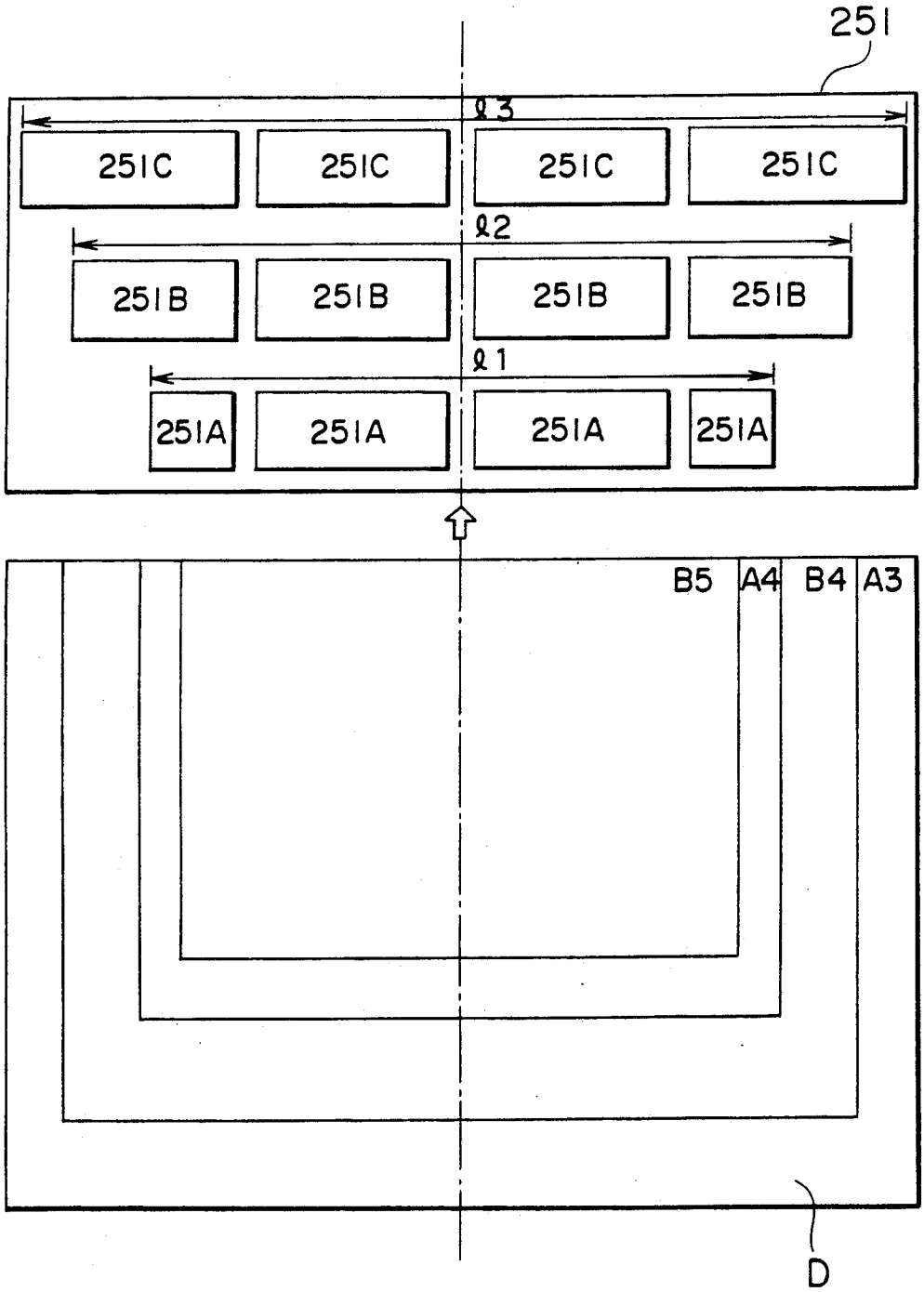
FIG. 6 is a schematic illustration which shows the relation between the developed plan of the third cylinder and the document size.

FIG. 6 is a development plan of the above-described most inside pipe member 251 and a schematic illustration to explain the relation between the pipe member and various document sizes.

Three kinds of openings 251A, 251B, 251C are provided to the circumferential surface of the most inside pipe member 251, wherein the length of the openings in the axial direction is different. As illustrated in FIG. 6, the distance between the openings 251A is defined, as l1. The distance l1 is set at about 295 mm, for example, so that the longitudinal size (257 mm) of B5 standard paper size and the longitudinal size (297 mm) of A4 standard paper size can be included. In the case of the openings 251B, l2 is set at about 360 mm, for example, which corresponds to the longitudinal size (364 mm) of B4 standard paper size. In the case of the openings 251C, l3 is set at about 420 mm, for example, which corresponds to the longitudinal size (420 mm) of A3 standard paper size.

The flanges 252, 253 are integrally engaged with the inside of the openings of both sides of the above-described most inside pipe member 251.

One of the flanges 252 is rotatably supported by the circumferential surface of the suction connecting pipe 236 through the bearing BR5 in the same way as the above-described flange 242.

The boss of the other flange 253 is engaged with the above-described flange 243 through the bearing BR6 and rotatably supported. The drive shaft 254 is fixed to the boss of the flange 253. The drive shaft 254 is penetrated through the boss of the above-described flange 243, and the toothed pulley P32 and the cam 255 are fixed to one end of the drive shaft 254.

The toothed pulley P32 is driven by motor M3 which is not illustrated in the drawings. Its drive means is the same as that of the above-described motor M, the toothed pulley, and the toothed belt.

The above-described cam 255 opens and closes the optical passage of the photointerrupter 256 so that the revolution of the most inside pipe member 251 is controlled.

The most inside pipe member 251 is rotated according to the document size and stopped at a predetermined position so that the most appropriate opening to the document size can be selected.

Figure 7A:
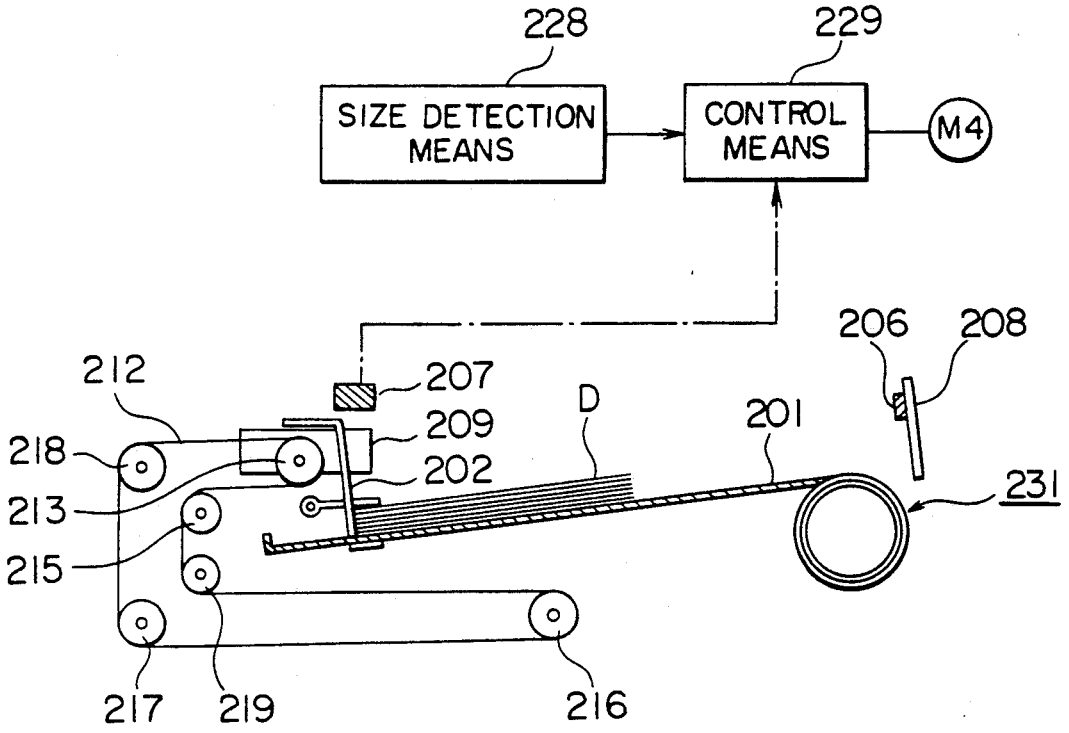
FIG. 7(A) and FIG. 7(B) are schematic illustrations of a circulation type of document feeding apparatus.
Figure 7B:
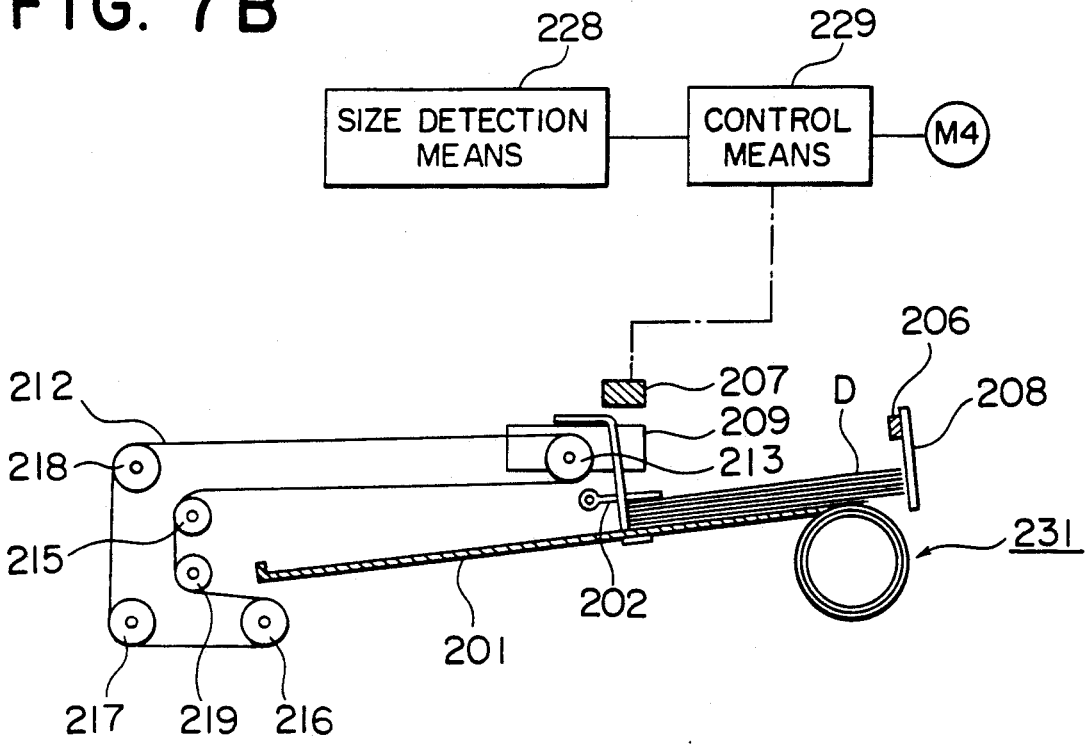

Referring now to FIGS. 7(A) and 7(B) which are schematic illustrations explaining the composition, and to FIGS. 8(A) to 8(E) which are sectional views of the suction cylinder unit, the working action of the apparatus will be explained.

(1) Documents are stacked and set on the document stacker 201 in such a manner that: the front side of a document is set upward; the documents are arranged in order of page to form a stack, wherein the uppermost document has the smallest page number; and the trailing end of the document stack is bumped against the trailing end regulating plate 202 which is located at its home position.

(2) Both sides of the documents are arranged by the document side regulating plate 203, so that the document size can be detected and stored. (the document size detecting means 228)

(3) The number of copies is inputted and the copy button is pressed in order to be turned on.

(4) By these operations described above, the separator 210 is rotated and the document is detected and confirmed by the sensor 207 which is used to detect the document setting.

Figure 8A:
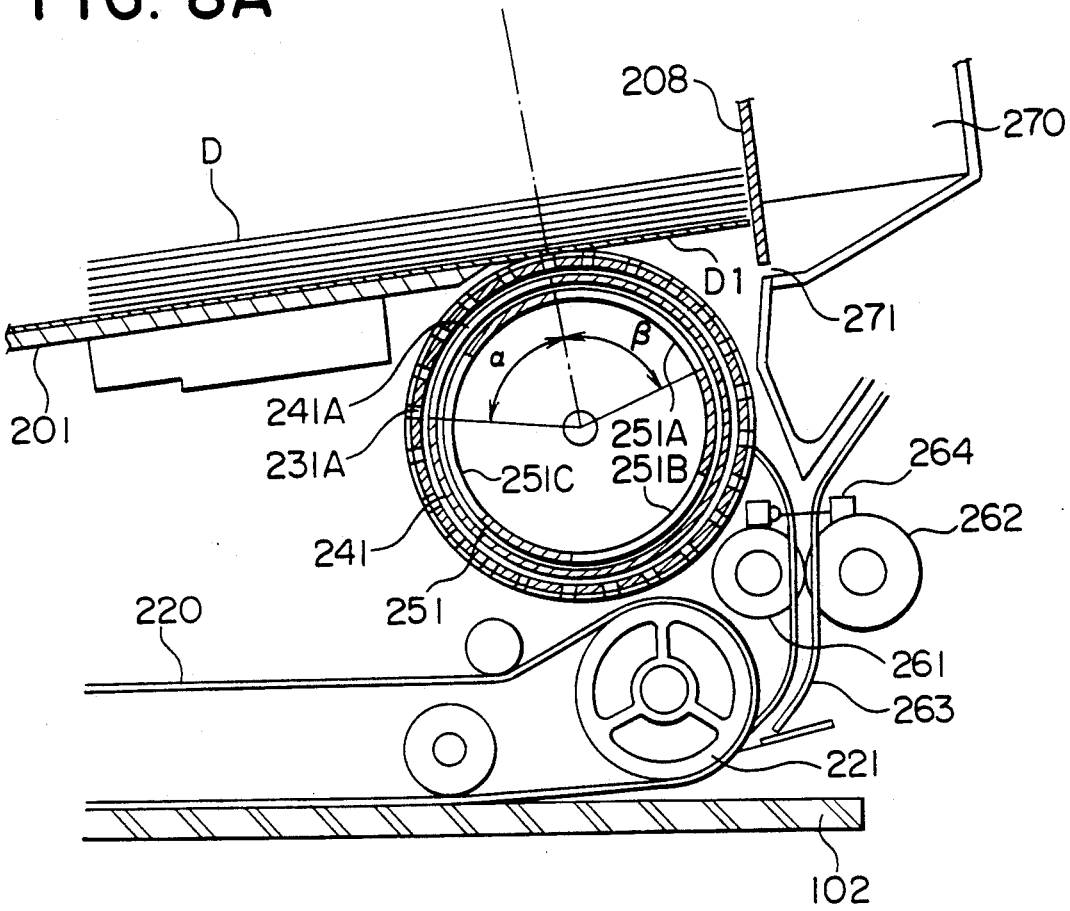
FIGS. 8(A), 8(B), 8(C), 8(D), and 8(E) are sectional views which illustrate the document feeding process of a document feeder.

(5) According to the document size signal by the process (2), the most inside pipe member 251 is rotated by motor M3 and stopped at a predetermined position. In other words, the suction width is changed by this operation. FIG. 8(A) illustrates the state of the apparatus just before the suction is started. In this state, both pipe members are stopped and the relation between the opening 241A of the middle pipe member 241 and the opening 251A of the most inside pipe member 251 is to close the suction as a whole.

(6) Then, motor M4 which is the power source of the delivery belt 212 is started, so that the upper edge portion roller 213 which is provided to the upper moving unit 209, can be moved forward in the direction of document feed and so that the lower edge-portion roller 216 which is provided to the lower moving unit, can be moved backward in the direction of document feed. The trailing end regulating plate 202 which is provided to the upper moving unit 209, is advanced pushing the trailing end of document D, and when the stack sensor detects that the leading edge of document D has bumped against the document stopper 208,,the power source M4 is stopped by the action of the control means 229. Refer to FIG. 7(B). At this moment, the tip of the document stack overhangs the contact point between the document and the most outside pipe member 231 so that the document is protruded by its stiffness. Refer to FIG. 8(A).

(7) The suction means of the suction cylinder unit 230 is turned on, and the pressure inside the suction pipe 235, the suction connecting pipe 236, and the most inside pipe member 251, is made negative by the negative pressure generated by the suction unit. At the same time, the blast means 270 is turned on and the compressed air is blown from the outlet 271 against the outer circumferential surface of the most outside pipe member 231 of the suction cylinder unit 230. However, the most outside pipe member 231, the middle pipe member 241, and the most inside pipe member 251 are stopped and the openings 241A and 251A are not matched with each other as illustrated in FIG. 8(A), so that the air of negative pressure can not pass through the openings and document D can not be sucked.

Figure 8B:
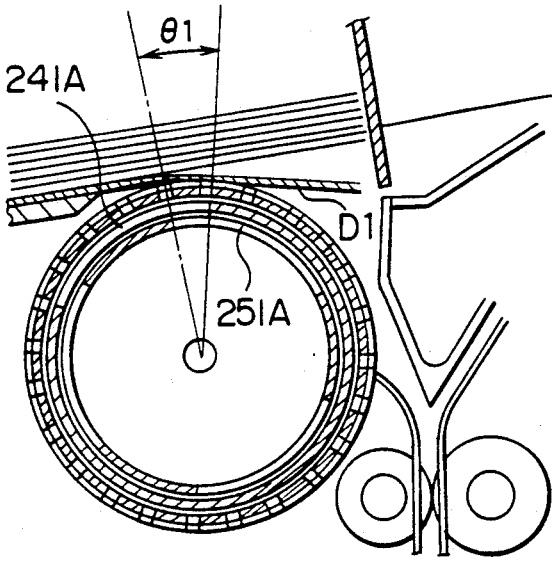

(8) Successively, the middle pipe member 241 is rotated by motor M2 and the opening 241A is rotated clockwise, so that the relative opening angle $\theta 1$, which is formed by the opening 241A and the opening 251A of the most inside pipe member 251 in the stopped condition, is gradually expanded and the opening ratio is increased. Refer to FIG. 8(B). At this moment, the most outside pipe member 231 is stopped. When the opening rate is increased, the suction generated by the suction unit sucks the contact portion of the lowermost document D 1 through the openings 251A, 241A and the small through-hole 231A, and the lowermost document is separated from the the stack and adhered to the circumferential surface of the most outside pipe member 231.

Figure 8C:
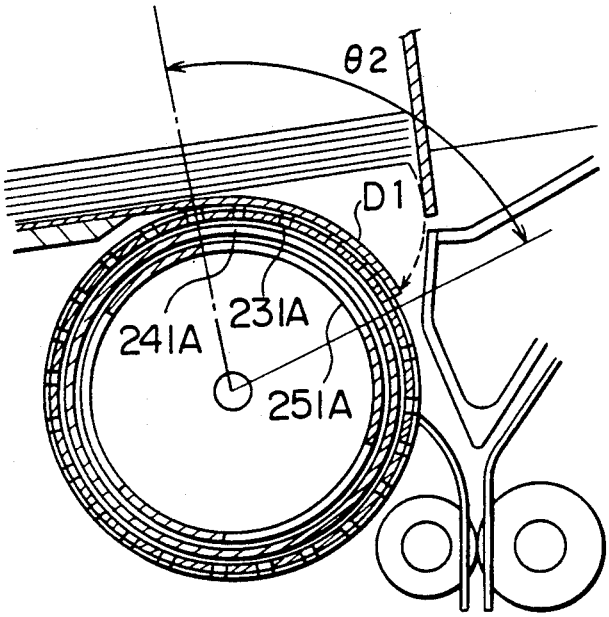

(9) When the middle pipe member 241 is further rotated and the opening 241A and the opening 251A are matched so that the state of full admission (the relative opening angle 82, the opening ratio 100%, in FIG. 8(C)) is formed, the above-described document D 1 is sucked by the suction which passes through the openings 251A, 241A and the small through-hole 231A, and the document comes into close contact with the outer circumferential surface of the most outside pipe member 231.

Figure 8D:
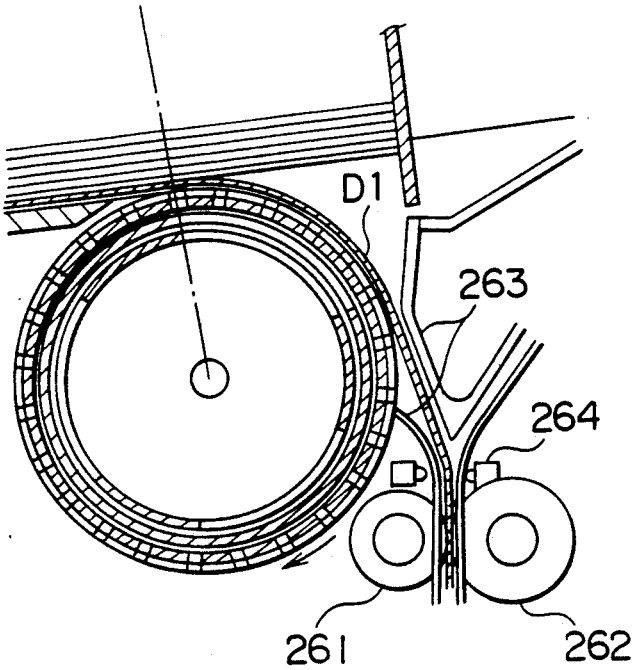
Figure 8E:
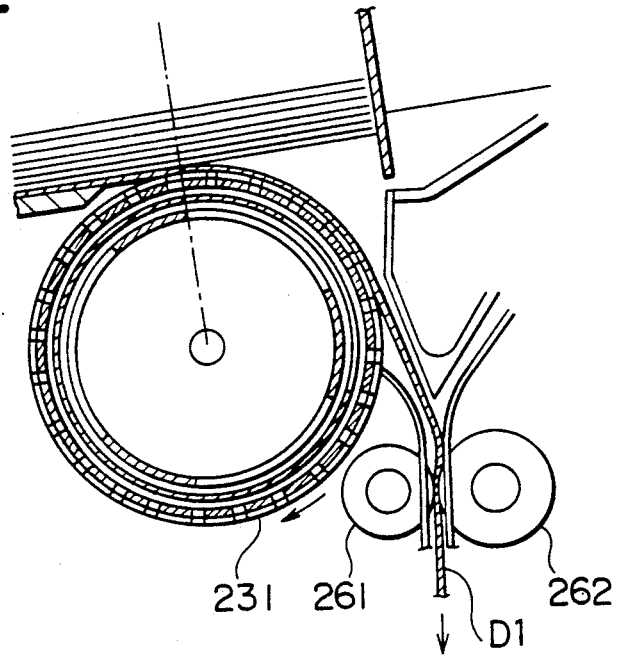

(10) While the document is sucked to the outer circumferential surface of the most outside pipe member, clutch K is turned on so that the most outside pipe member 231 is rotated by motor M1. Document D1 which is sucked to the outer circumferential surface of the most outside pipe member 231, is moved by the revolution of the most outside pipe member 231 and pulled out from the document stack so that it is conveyed. Then, the leading edge-portion of document D 1 is conveyed along the inside of the guide plate 263. The document leading edge detecting sensor 264 detects the leading edge of document D. After the leading edge of document D 1 is held by the intermediate conveyance rollers 261, 262, clutch K is turned off so that the revolution of the intermediate conveyance rollers 261, 262 is stopped holding the document D between them, wherein document D is kept waiting so that it can be conveyed synchronously with a transfer paper which is conveyed by a resisting roller of the paper feeding unit in the copier body 100 FIG. 8(D) is a partly sectional view of the document feeding unit in which document D 1 is kept waiting.

(11) The intermediate conveyance rollers 261, 262 are rotated again according to the paper feeding start signal to a transfer paper, and the leading edge of document D 1 is conveyed onto the contact position between the conveyance belt 220 and the platen glass 102 illustrated in FIG. 1. When document D1 is conveyed by the intermediate conveyance rollers, the most outside pipe member 231 is rotated by document D as an idler. The middle pipe member 241 is rotated clockwise in the arrowed direction and stopped when it reaches the initial position (FIG. 8(A)).

(12) In the way described above, a sheet of document D1 which has been sent out by the suction cylinder unit 230, enters into passage A. Document D1 is pinched by the intermediate rollers 261, 262 provided on the half way and conveyed to the contact position between the platen glass 102 and the conveyance belt 220 synchronously with the exposure speed. When the document leading edge detecting sensor 264 detects that the trailing end of document D1 has passed through the suction cylinder unit 230, the suction cylinder unit 230 starts to pull out the next document.

(13) Document D1 which has been conveyed by the above-described intermediate rollers 261, 262, is conveyed on the platen glass 102 by the conveyance belt 220 synchronously with the exposure speed and exposed by the stationary optical system 110 so that the document image can be formed on a photoreceptor drum. After exposure, document D 1 is conveyed upward along the delivery guide plate 225 and delivered to the document stacker 201 by the delivery belt 212. When document D1 is stacked on the stacker again, the leading edge and the trailing end of document D1 which is delivered onto the document stacker 201, are arranged by the document stopper 208 and the trailing end regulating plate 202, and both sides of the documents are arranged by the side regulating plates 203, 203. The previously stacked documents D and the circulated document D1 are sorted by the document separator 210. The above-described document feeding motion is repeated until all of the documents D on the document stacker 201 are fed. When the stack sensor 206 detects that all of the documents D have been fed and the delivery, sensor detects that the last document D has been delivered, the stacked documents are sent out from the document stacker by the trailing end regulating plate 202, wherein the above-described motions are repeated until the copies of a predetermined number are obtained. When the above-mentioned delivery sensor detects that the copies of a prescribed number have been obtained, the trailing end regulating plate 202 is returned to its initial position in order to prepare for the next operation. The motions of a case in which a one sided document is copied onto one side of a recording paper in RDH mode, are described above. When a two-sided-document is copied onto one side of two recording papers in RDH mode or a two-sided-document is copied onto both sides of a recording paper, the document is guided into reverse passage E.

The suction cylinder unit of the threefold structure of the present invention can be effectively applied to the document feeding apparatus of the document bottom feed type. It can also be applied to a paper feeding apparatus in which a paper is fed in such a manner of bottom feeding.

As explained above, the present invention provides a document feeding apparatus in which a stack of documents located on a stacker are moved in the direction of document feed and the lowermost document of the document stack is separated one by one from the document stack by a separation means in order to feed the document, and which is characterized in that: document feed, document separation , and document conveyance are conducted by a suction cylinder unit composed of a cylinder with a threefold pipe structure and of a suction means. Accordingly, it is not necessary to press a document stack, so that the stain on the front side and reverse side of a document which is caused by rubbing, can be prevented and the damage of an image caused by rubbing can be also prevented. Further, the document separation efficiency is improved, so that a thin document can be separated and conveyed stably. Furthermore, since a document is sucked by a pipe, the whole circumferential surface of which is provided with holes, the document surface is uniformly sucked to the pipe surface and conveyed without causing wrinkles and document skew conveyance.

When a document is sucked and conveyed, the document is held by a rubber (synthetic rubber) coated surface of the most outside pipe member, wherein the coefficient of friction of the rubber surface is large. Accordingly, even when negative pressure of suction is small, slippage between the document and the rubber surface does not occur so that the document can be stably conveyed, whereby the vacuum suction unit can be made compact, electricity can be economized, and the production cost of the equipment can be reduced.

The slit-shaped openings of the second or the third cylinder can be rotatably selected according to the document size, in other words the document width, so that the suction air can effectively suck the document surface. Accordingly, the apparatus of the invention is very effective for separation and conveyance of various size of documents. Further, the slit can be easily and rapidly changed over.

Another example of the apparatus of the present invention will be described as follows.

Figure 9:
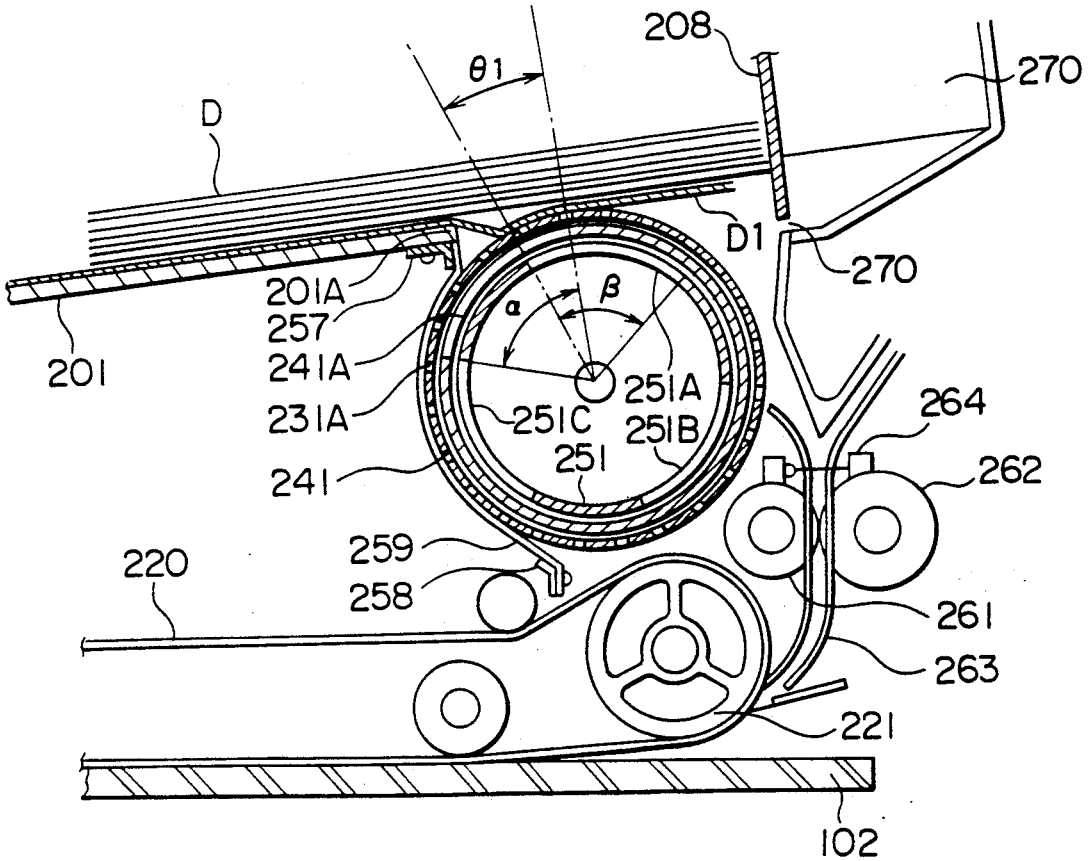
FIG. 9 is a sectional view of another example of a document feeding apparatus.
Figure 10:
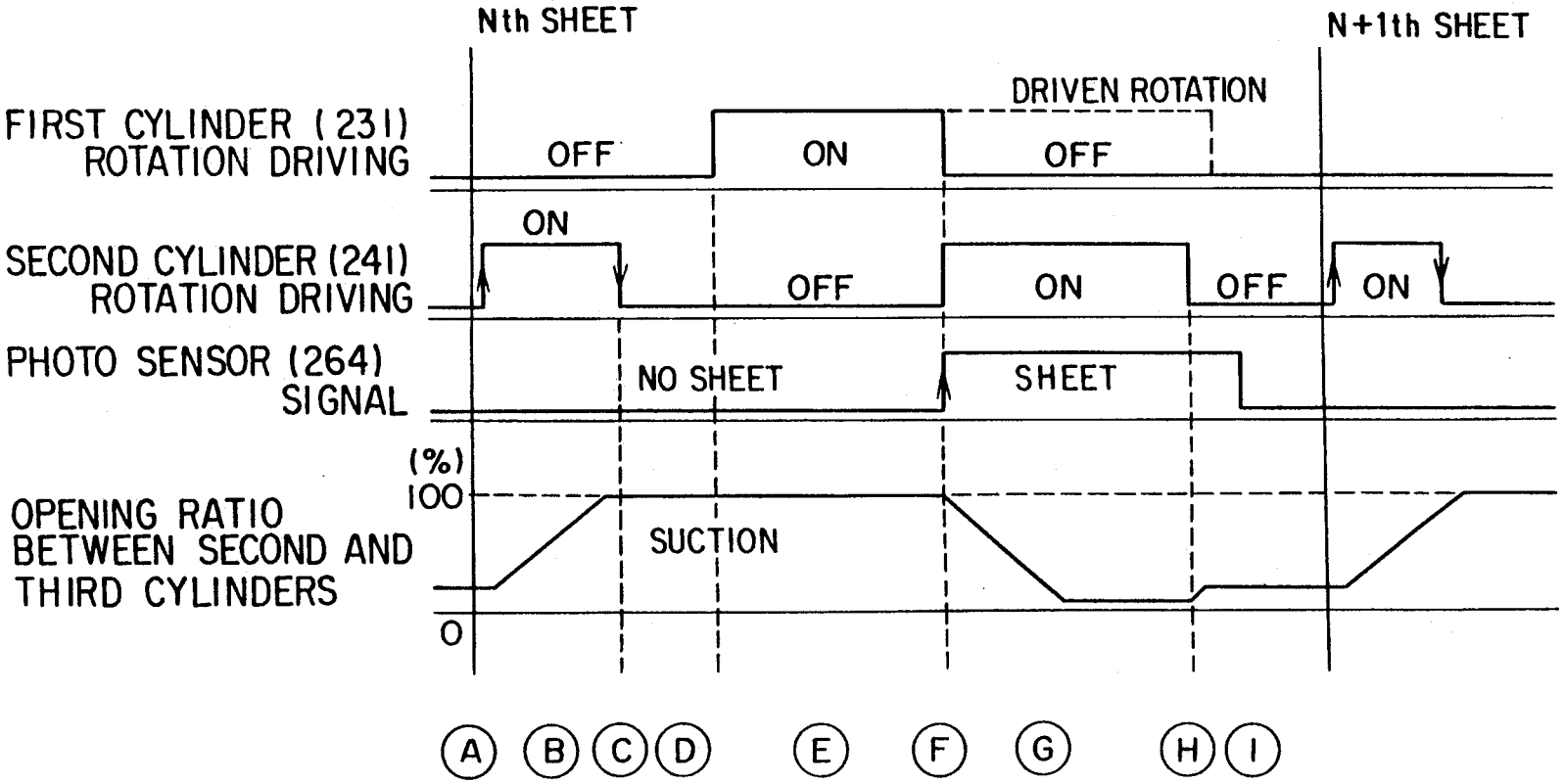
FIG. 10 is a time chart of a document feeding process.

Referring now to FIGS. 8(A) to 8(E) and FIG. 9 which are the sectional views of the suction cylinder, and referring to the time chart in FIG. 10, the control motions of a recirculating document handler (RDH) to which another example of the present invention is applied, will be described.

In this example, the steps (1) to (4) are the same as those in the previous example. At the step (5) in this example, when the most inside pipe member 251 is rotated by motor M3 and stopped at a predetermined position, the opening portion 251A of the most inside pipe member 251 and the opening portion 241A of the middle pipe member 241 are stopped and they form a relative opening angle Q1 (10 ° to 30°) as illustrated in FIG. 9. After that, at the step (7), when the suction means of the suction cylinder unit 230 is turned on, the opening portions 241A, 251A are in the state of suction and an opening is formed, the relative opening angle is Q1, as illustrated in FIG. 9. Consequently, the leading edge-portion of the lowermost document D1 is sucked by the negative pressure suction through the relative opening angle Q1 and separated from the document stack so that the document comes into close contact with the outer circumferential surface of the most outside pipe member 231. The document D1 is kept waiting in the preliminary state of close contact until document feed is started. (Refer to the step A of FIG: 10.)

At the steps (8) and (9), when the middle pipe member 241 is further rotated and the opening 241A and the opening 251A are matched with each other so that they form a full opening state (the relative opening angle; $\theta 3$, the rate of opening; 100%), the above-described document D1 is sucked by the negative pressure suction which passes through the opening portions 251A, 241A and small through-holes 231A, so that the document D1 comes into close contact with the outer circumferential surface of the most outside pipe member. (Refer to the steps B and C in FIG. 10.)

In this state (The middle pipe member 351 is stopped. The relative opening angle is 100%. The suction is conducted.), Document D is kept waiting for a predetermined time (about 30 to 100 ms). (The step C in FIG. 10 is maintained.) Even when there exists a document D1 which is not separated from the document stack during the revolution of the above-described middle pipe member 241 and which does not come into close contact with the surface of the most outside pipe member 231, due to the full opened slit in the state of stop and the continuous suction the document is sure to come into close contact with the outer circumferential surface of the most outside pipe member 231 being sucked. (Refer to the step D of FIG. 10.)

After that, in the same way as the step (10), while the document is sucked, clutch k is turned on so that the most outside pipe member 231 can be rotated by Motor Ml. Document D1 which comes into contact with the rubber coated circumferential surface of the most outer pipe member 231, is moved by the revolution of the most outside pipe member 231 being sucked to the rubber coated surface and pulled out from the bottom of the document stack. (the step E in FIG. 10)

In this example, the leading edge of document D1 is advanced along the inside of the guide plate 263. When the document leading edge sensor detects the passage of document D (FIG. 8(D)), motor M2 is started by the signal from the sensor and the middle pipe member 241 is rotated, so that the relative opening angle (the opening ratio) formed by the middle pipe member 241 and the most inside pipe member 251, is gradually decreased. At this moment, motor Ml is stopped and clutch K is turned off, so that the most outside pipe member 231 is rotated as an idler (the steps F to G in FIG. 10). When motor M1 is stopped, the intermediate conveyance rollers 261, 262 are once stopped. After the intermediate conveyance rollers 261, 262 have been rotated by inertia, the rollers are stopped in the state of holding the leading edge of the document so that the document can be fed synchronously with a recording paper which is fed by the registing roller located in the paper feed unit in the copier 100 body.

After that, in the same way as the step (11), the intermediate rollers 261, 262 are started again according to the recording paper feed signal, and the leading edge of document D is conveyed to the contact position of the conveyance belt 220 and the platen glass 102. In this example, when document D is conveyed to the contact point, the most outside pipe member 231 is rotated by document D as an idler. The middle pipe member 241 is rotated in the arrowed clockwise direction, and it is stopped when it reaches the initial position at which the relative opening angle becomes 0, wherein the slit is in a closed state. (Refer to the step H in FIG. 10.)

Before the document leading edge detecting sensor 264 detects that the trailing end of document D1 has passed through the suction cylinder unit 230, the suction means of the suction cylinder unit 230 is turned on again, and suction is started to prepare for the suction of the next document. (Refer to the step I in FIG. 10.)

In this example, before document feed is started, the relative opening angle formed by the openings of the middle pipe member and the most inside pipe member, is opened a little in advance so that the preliminary suction can be conducted. For that reason, the leading edge of a document positively comes into contact with the most outside pipe member. Therefore, improper conveyance of document such as waving and skewing can be prevented and the efficiency of document separation is remarkably increased.

When the cylinder is stopped for a moment in the process of document separation, the efficiency of document separation can be remarkably increased.

In the example described above, as a matter of explanatory convenience, both of the preliminary suction at the opening angle of Q1 (10° to 30°) and the continuous suction for a predetermined period at the opening rate of 100%, are adopted. However, even when either of two is adopted, it is possible to improve the efficiency of document separation.

To change the subject slightly, in the sectional view of the main portion of the document feed apparatus illustrated in FIG. 9, the front edge-portion 201A of the document stacker 201 is located at the position a little backward with regard to the initial contact position between the above described most outside pipe member 231 and the lowermost document D1.

The upper anchoring member 257 is fixed to the lower face of the front edge-portion 201A of the above-described document stacker 201. On the other hand, the lower anchoring member 258 is fixed to the apparatus body at the position close to the lower portion of the most outside pipe member 231. The seal member 259 are fixed to the above-described anchoring members 257 and 258. The seal member 259 is made of a sheet which is made from wear resisting flexible material such a$ polyethylene terephthalate. Both edges of this seal member 259 are fixed to the above-described anchoring members 257 and 258, and the intermediate portion of the seal member is wound around the above-described most outside pipe member 231 in such a manner that it slightly comes into contact with a portion of the pipe member 231. Consequently, some of small through-holes 231A of the most outside pipe member 231 are closed by the seal member 259, so that the suction loss is decreased and the efficiency of negative pressure suction by the relative through-hole formed by the opening 241A provided to the middle pipe member 241 and the opening 251A provided to the most inside pipe member 251, is improved.

Figure 11A:
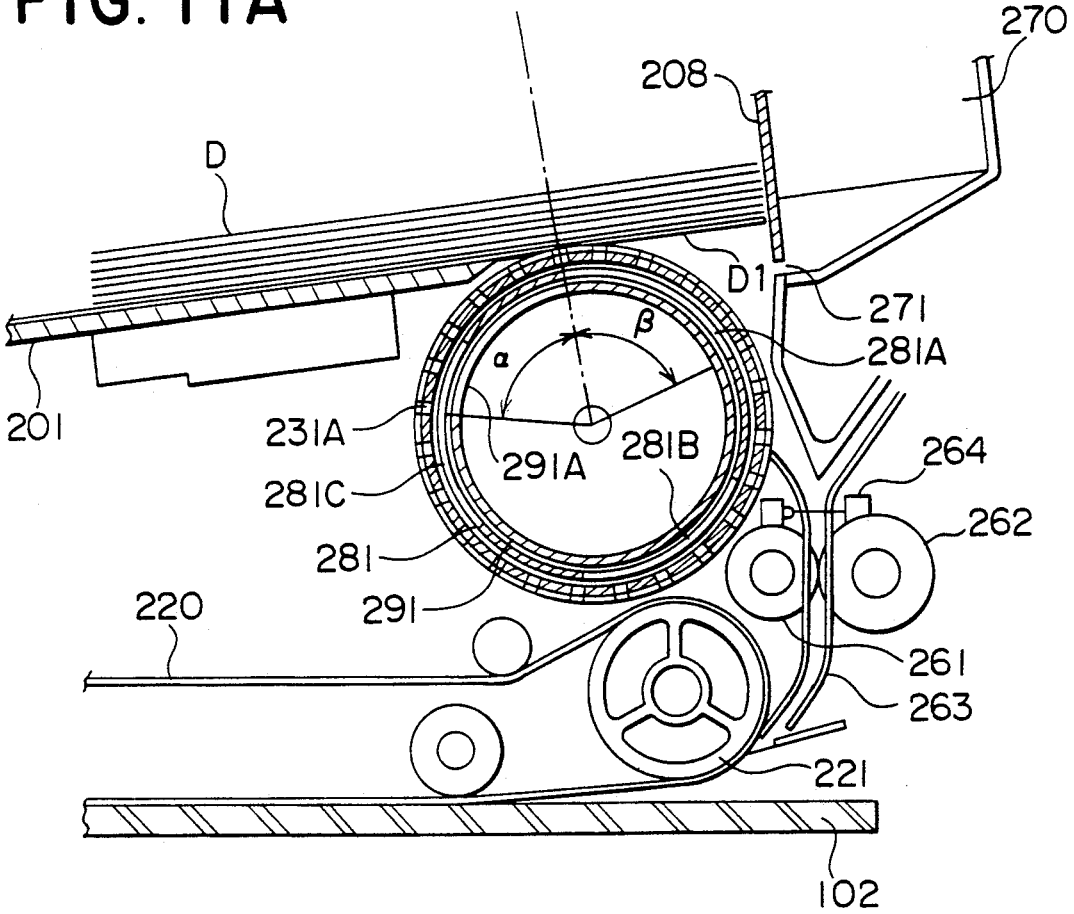
FIG. 11(A) and FIG. 11(B) are sectional views of another example of the threefold pipe mechanism of the present invention.
Figure 11B:
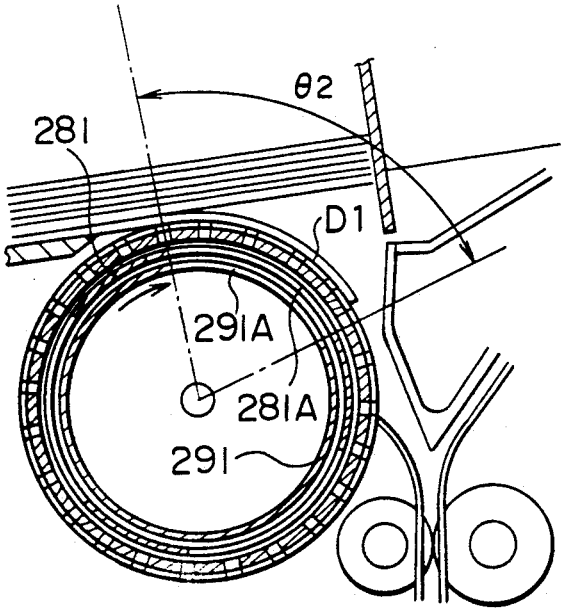

FIG. 11 is a sectional view of another example of the threefold pipe structure document feed apparatus of the present invention. In this example, the second cylinder 281 which is located at the intermediate position is fixed, and the third cylinder which is located at the most inside position is rotatable. The second cylinder 281 is provided with the openings 261A, 261B, 261C, the suction length of which can be varied. The third cylinder 271 is provided with the opening 271A, which performs the function of a shutter to vary the suction opening ratio. FIG. 11(A) shows the state in which document feed is going to start. The opening portion 281A of the second cylinder 281 crosses with the opening portion 291A of the third cylinder 291 so that the closed state is formed (the opening ratio; 0%). FIG. 11(B) shows the state in which the third cylinder 291 is rotated clockwise by the angle $\theta 2$ and the cylinder is temporarily stopped, wherein the above-described openings 281A, 291A are matched so that the open state is formed (the opening rate; 100%). In this state, as described before (Refer to FIG. 8(C)), document D1 is sucked by the negative pressure suction which passes through the openings 281A, 291A and small through-holes 231A of the first cylinder 231 so that document D1 comes close contact with the outer circumferential surface of the first cylinder 231 and successively document D is conveyed in the clockwise direction.

Figure 12:
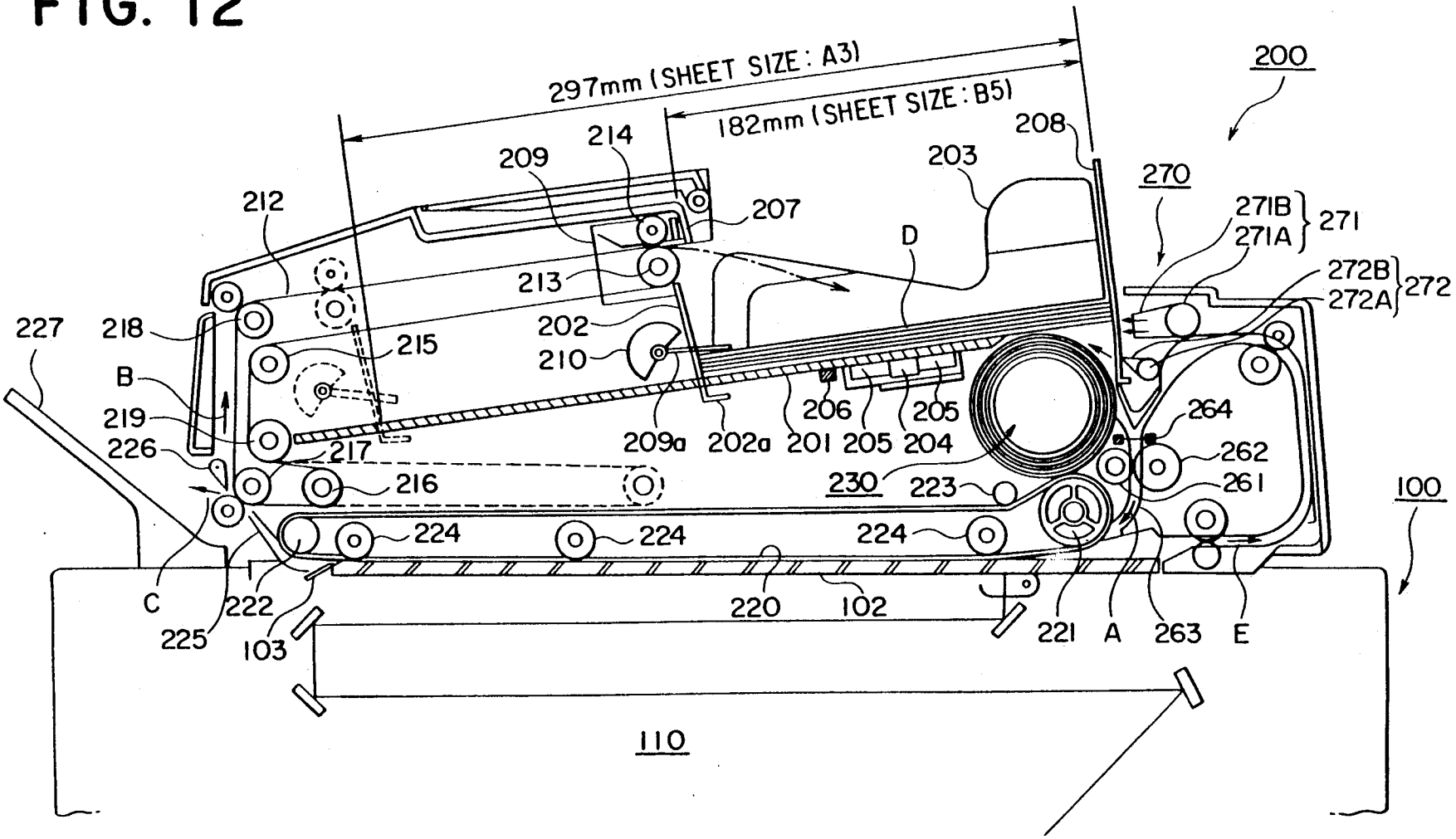
FIG. 12 is a sectional front view of a document feeding apparatus in which an example of the document feeding unit with the blast means of the present invention is used.

An example of the blast means will be explained as follows. As illustrated in FIG. 12, the blast means 270 is located at the position close to the lower back side of the document bumping plate 208 in this example. The blast means is composed of the first blast means 271 located upward and the second blast means 272 located downward.

The above-described blast means 271 is connected with a blast fan not illustrated in the drawing and composed of the blast duct 271A which is provided in parallel with the side of a document and the width of which is the maximum document size, and composed of a plurality of air nozzles (the first compressed air outlets) 271B which are connected with the blast duct 271A. The air nozzles 271B form an air stream which is directed to the position close to the front edge-portion of document stack D on the document stacker 201. This air stream forms an angle of 5 to 10 with regard to the surface of the document stacker, wherein the the air stream is blown upward against document D. The air stream of these air nozzles 271B is a compressed air stream which diffuses in the direction which makes a right angle with the document surface.

The diffused air stream ejected from the above-described air nozzles 271B is blown upward with regard to the front edge-portion of document stack D so that it can be blown into the spaces between documents D. Since the air stream is blown against documents D, the weight of document stack D is offset and when the lowermost document of the document stack D is pulled out, the weight of the document stack loaded on the lowermost document is lightened, so that stain of document caused by rubbing can be prevented.

The second blast means 272 has almost the same structure as the above-described first blast means 271, and it is composed of the air duct 272A connected with the blast fan and a plurality of air nozzles 272B (the second compressed air outlets) connected with the air duct 272A. The air nozzles 272B are provided only to the middle portion with regard to the direction of the document width.

The air nozzles 272B eject a compressed air stream against the front edge-portion of the lowermost document which is separated from the document stack on the document stacker 201 by the suction force of the most outside pipe member 231 of the above-described vacuum conveyance unit 230.

When the lowermost document is sucked and separated from the document stack, the air stream ejected from the above-described air nozzles 272B is blown against the document in the tangent direction at the point where the leading edge of the document is wound around the most outside pipe member 231 so that double feed of document can be prevented.

The blast fan of the above-described first blast means 271 and the blast fan of the second blast means 272 may be independently provided. However a single fan and a branch of air duct may be also used.

Figure 13:
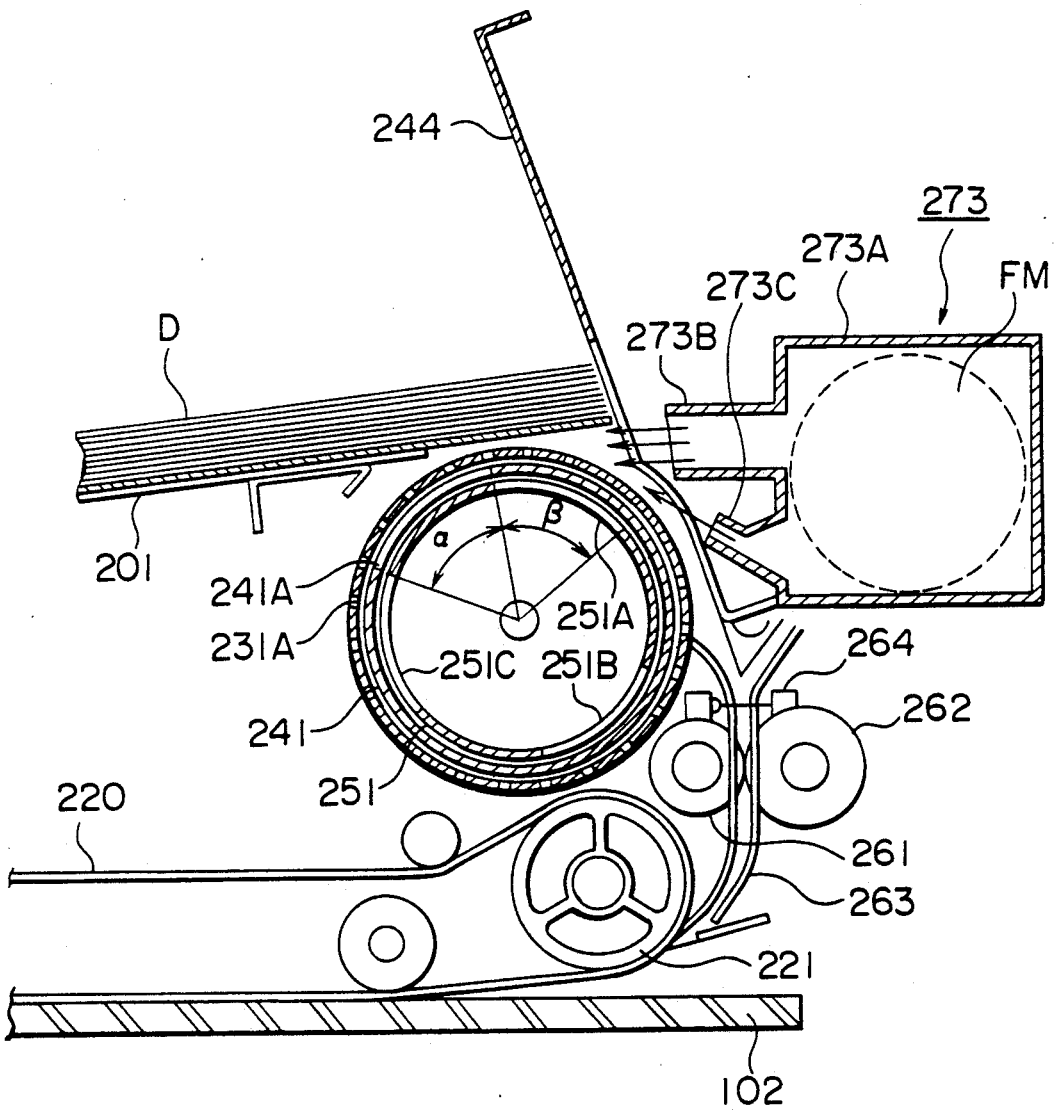
FIG. 13 is a sectional view which explains the document feeding process of a document feeding unit including the blast means.
Figure 14:
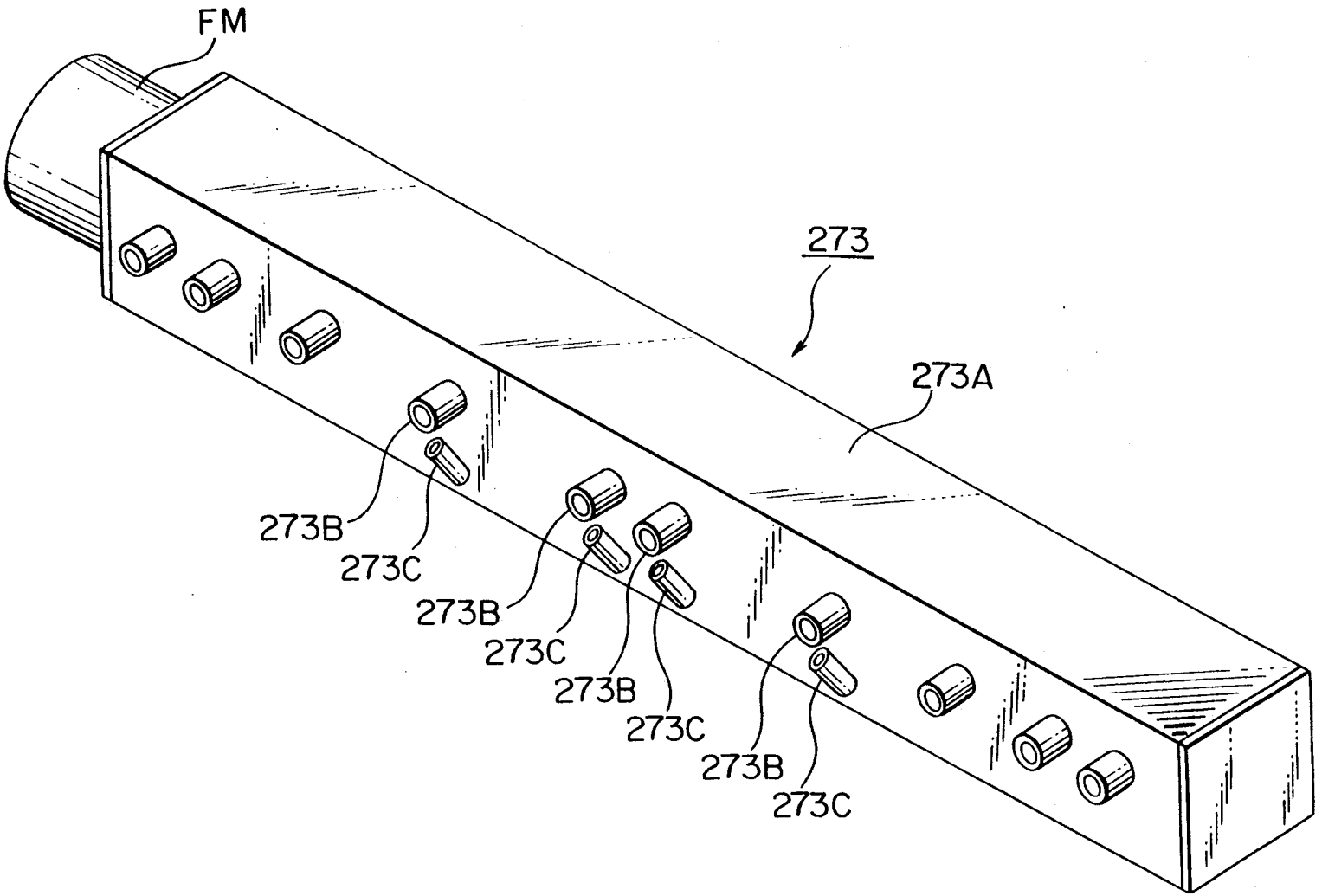
FIG. 14 is a perspective view of another example of the blast means.

The blast means 273 illustrated in FIG. 13 is another example of the above-described blast means 270. (Refer to FIG. 12.) FIG. 14 is a perspective view of the blast unit 273. A plurality of first compressed air nozzles (the blast nozzles) 273B are connected with the upper portion of a single air duct 273A which is connected with the air outlet of a single fan motor FM. The air nozzles 273B is provided in such a manner that the nozzles can cope with various document sizes from the maximum document size (for example, A3 size of 420 mm length) to the minimum document size (for example, B5 size of 257 mm length).

A plurality of second compressed air outlets (the air nozzles) 272C, the number of which is smaller than the above-described outlets 273B, are connected with the lower portion of the air duct 273A. The outlets 273C are provided to the middle portion and eject the compressed air upward in the same way as the above-described air nozzles 272B.

Figure 15:
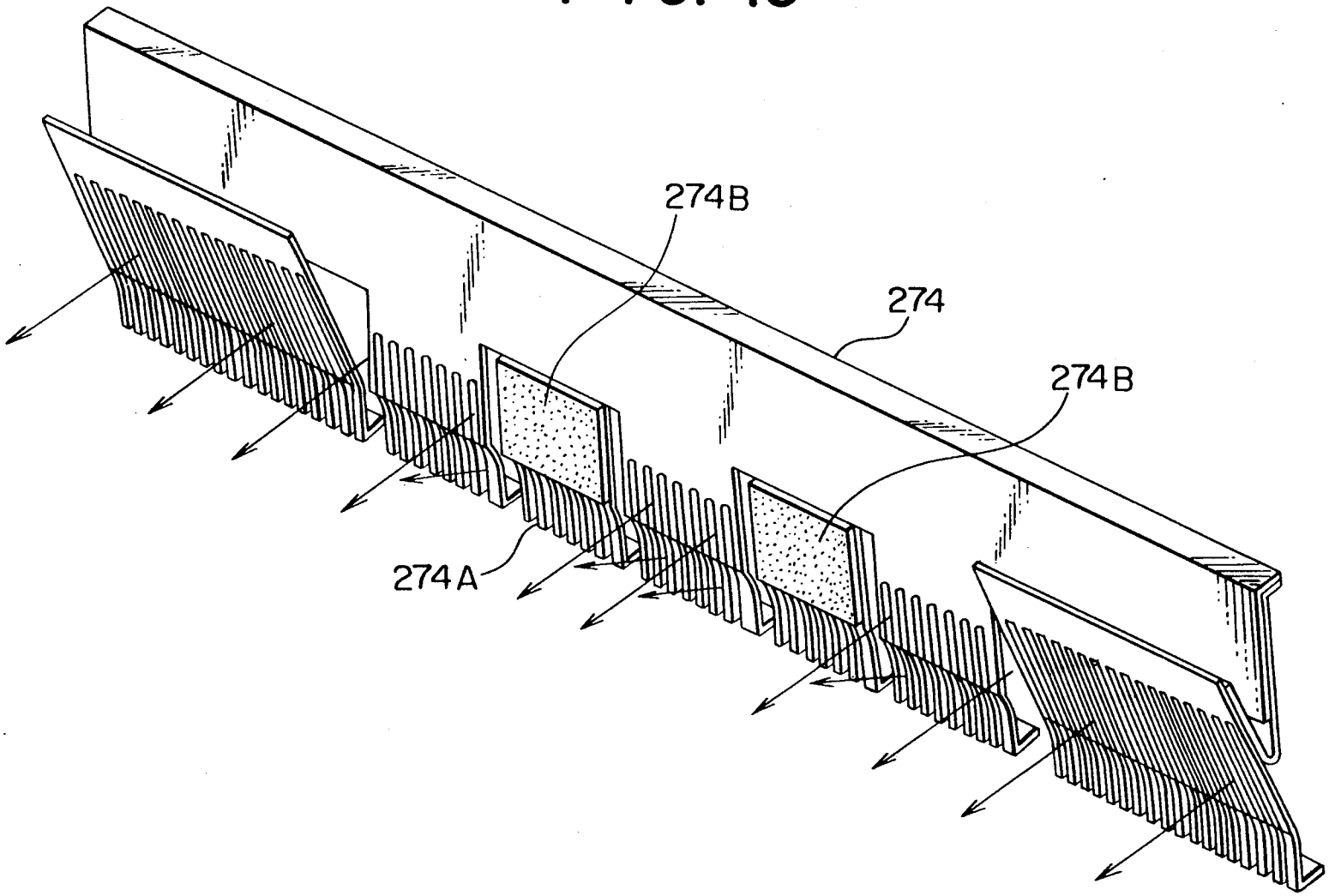
FIG. 15 is a perspective view of a document bumping plate which is installed opposite to the blast means.

FIG. 15 is a perspective view of the document bumping plate 274 which is provided to the front of the above-described blast unit 273.

A plurality of vertical slits 274A are provided to the lower portion of the document bumping plate 274 so that the air stream from the outlets 273B, 273C of the blast means 273 (not illustrated in the drawing) installed at the back of the document bumping plate 274, can pass through in the arrowed direction. The lower portion of the above-described document bumping plate 274 performs the function of a guide plate which forms the document passage in the vicinity of the circumferential surface of the above-described most outside pipe member 231. Two resilient members 274B are adhered to the vicinity of the middle portion of the above-described document bumping plate 274. The resilient members 274B are made from foamed synthetic rubber, so that their resilient friction force is effective to prevent double feed of document when a document is sucked and separated from a document stack.

In this composition, at the above-described step 7, when the suction means of the suction cylinder unit 230 is turned on and the pressure at the most inside pipe member 251 is made negative by the negative suction from the suction source, fan motor FM of the blast means 273 is also turned on and the compressed air is ejected from the air nozzles 273B, 273C, so that the air stream is blown against the front edge-portion of document stack D and against the outer circumferential surface of the most outside pipe member 231 of the suction cylinder unit 230. At the same moment, the air stream sent from the above-described blast means 270 is blown against the leading edges of document D which are in the state of hanging and air is sent into the spaces among documents, so that double feed can be prevented and the efficiency of separation can be improved. Even when two sheets of documents placed on the lowermost document are pulled out during the suction of the lowermost document, the documents are separated and blown upward by the air stream ejected from the nozzles 273C, wherein the air stream is blown in the tangent direction of the most outside pipe member 231. Accordingly, the document separation efficiency is improved and thin documents can be stably separated and conveyed. Furthermore, the suction is conducted by the whole circumferential surface of a cylinder which is provided with holes, so that the document surface can be uniformly sucked. As a result, the problems of wrinkles on a document and skewing in document conveyance can be prevented.

What is claimed is:

1. An apparatus for feeding a paper, said apparatus comprising:

a stacker for holding a stack of papers;

a vacuum-type feed for separating a lowermost paper, by vacuum suction, from the stack of papers placed on the stacker, and sequentially feeding the separated papers, one by one, by vacuum suction to a set of rollers downstream from the vacuum feed, said vacuum-type feed being disposed below said stacker adjacent a leading edge of said stacker in relation to a feeding direction, said vacuum-type feed including, an outer cylinder rotatable and provided with a number of through holes along the entire circumferential surface thereof, an inner cylinder, inside the outer cylinder, provided with an opening on a circumferential surface thereof, wherein the inner and outer cylinders are arranged on a single axis and circumferential surfaces thereof are concentric therewith, vacuum suction connected to said inner cylinder, and, an air blast for blowing compressed air to separate the lowermost paper from said stack of papers.

2. The apparatus of claim 1, wherein the air blast means comprises the first air blast member for blowing the compressed air to the leading edge of the stack of papers and the second air blast member for blowing the compressed air in the upward direction tangent to the circumferential surface of the outer cylinder.

3. The apparatus of claim 2, wherein the first air blast member blows the compressed air to spread in the upward direction in relation to the thickness of the stack of papers.

4. The apparatus of claim 2, wherein the second air blast member blows the compressed air to form air stream concentrating at the leading edge of the paper separated onto the outer cylinder.

5. The apparatus of claim 2, wherein the first and second air blast members are connected to a common air pipe.

6. An apparatus for feeding a paper comprising:

a stacker for holding a stack of papers; and three-fold cylinder member for separating the lowermost paper, by vacuum suction, from the stack of papers placed on said stacker, and sequentially feeding the separated paper, one by one, by vacuum suction to a set of rollers downstream from the cylinder member, said three-fold cylinder member being disposed below said stacker adjacent a leading edge of said stacker in relation to a feeding direction, said three-fold cylinder including a first cylinder rotatable and provided with a number of through holes along the entire circumferential surface thereof, a second cylinder, inside said first cylinder, provided with an opening on a circumferential surface thereof, a third cylinder, inside said second cylinder, provided with an opening on a circumferential surface thereof, wherein said first, second and third cylinders are arranged on a single axis and said circumferential surfaces are concentric therewith, and vacuum suction connected to said third cylinder.

7. The apparatus of claim 6, wherein either the second or third cylinder is made rotatable and the other cylinder is made stationary.

8. The apparatus of claim 7, wherein the lowermost paper is separated onto the first cylinder as a composed opening formed between the openings of both the second and third cylinders is gradually opened from the closed condition by rotating the rotatable cylinder, thereafter the separated lowermost paper is fed by rotating the first cylinder.

9. The apparatus of claim 8, wherein, after the composed opening has been opened to the full open condition by matching both the openings, the first cylinder is made to start rotating.

10. The apparatus of claim 8 wherein said through holes are distributed on said circumferential surface of said first cylinder.

11. The apparatus of claim 10, wherein, below the stacker, a sheet like seal member is provided to come in close contact with a part of the first cylinder for preventing vacuum suction.

12. The apparatus of claim 8, wherein the first cylinder is made to start rotating at a predetermined time period after the composed opening has been opened to the full open condition by matching both the openings.

13. The apparatus of claim 7 wherein the lowermost paper is separated by providing an initial opening between the openings on said second and third cylinders, before the composed opening is gradually opened.

14. The apparatus of claim 6, further comprising air blast means for blowing compressed air to separate the lowermost paper from the stack of papers.

15. The apparatus of claim 14, wherein the air blast means comprises the first air blast member for blowing the compressed air to the leading edge of the stack of papers.

16. The apparatus of claim 14, wherein the air blast means comprises the second air blast member for blowing the compressed air in the upward direction tangent to the circumferential surface of the first cylinder.

17. The apparatus of claim 6, wherein a layer with a large friction coefficient is formed on the circumferential surface of the first cylinder.

18. The apparatus of claim 17, wherein the layer is made of a rubber sheet.

19. The apparatus of claim 6, wherein the opening of either the second or third cylinder is arranged in the axial direction on the circumferential surface and the opening of the other cylinder consists of a plurality of openings differing in length in the axial direction corresponding to a plurality of paper sizes to be fed.

20. The apparatus of claim 19 further comprising a paper size signal generator wherein the other cylinder having the plurality of slit-shaped openings is rotated to a predetermined rotation position in accordance with a paper size signal generated by said paper signal generating means.

21. The apparatus of claim 6 wherein said openings provided on said second cylinder and third cylinder are slit-shaped.

22. The apparatus of claim 6, wherein the top of the circumferential surface of the first cylinder is positioned not higher than the lowermost paper located on the stacker.

* * * * *